US010676898B2

(12) United States Patent
Takahashi et al.

(10) Patent No.: US 10,676,898 B2
(45) Date of Patent: Jun. 9, 2020

(54) HYDRAULIC DRIVE SYSTEM OF WORK MACHINE

(71) Applicant: Hitachi Construction Machinery Tierra Co., Ltd., Koka-shi, Shiga (JP)

(72) Inventors: Kiwamu Takahashi, Moriyama (JP); Taihei Maehara, Koka (JP); Kazushige Mori, Moriyama (JP); Yoshifumi Takebayashi, Koka (JP); Natsuki Nakamura, Koka (JP)

(73) Assignee: Hibachi Construction Machinery Tierra Co., Ltd., Koka-shi (JP)

( * ) Notice: Subject to any disclaimer, the term of this patent is extended or adjusted under 35 U.S.C. 154(b) by 0 days.

(21) Appl. No.: 16/326,754

(22) PCT Filed: Dec. 14, 2017

(86) PCT No.: PCT/JP2017/044981
§ 371 (c)(1),
(2) Date: Feb. 20, 2019

(87) PCT Pub. No.: WO2018/110673
PCT Pub. Date: Jun. 21, 2018

(65) Prior Publication Data

US 2019/0177953 A1 Jun. 13, 2019

(30) Foreign Application Priority Data

Dec. 15, 2016 (JP) ..... 2016-243787

(51) Int. Cl.
*E02F 9/22* (2006.01)
*F15B 11/05* (2006.01)
(Continued)

(52) U.S. Cl.
CPC ..... *E02F 9/2267* (2013.01); *E02F 9/22* (2013.01); *E02F 9/2225* (2013.01); *F15B 11/00* (2013.01);
(Continued)

(58) Field of Classification Search
CPC ..... E02F 9/2267; E02F 9/22; E02F 9/2225; E02F 9/2296; E02F 9/2292; F15B 11/02; F15B 2211/20546; F15B 11/05
See application file for complete search history.

(56) References Cited

U.S. PATENT DOCUMENTS 7,571,558 B2 * 8/2009 Horii ..... E02F 9/2239 37/348
9,506,480 B2 * 11/2016 Hiraku ..... E02F 9/2235
(Continued)

FOREIGN PATENT DOCUMENTS

JP 2001-355257 A 12/2001
JP 2007-10044 A 1/2007
(Continued)

OTHER PUBLICATIONS

International Search Report (PCT/ISA/210) issued in PCT Application No. PCT/JP2017/044981 dated Mar. 20, 2018 with English translation (two (2) pages).
(Continued)

*Primary Examiner* — Abiy Teka
(74) *Attorney, Agent, or Firm* — Crowell & Moring LLP

(57) ABSTRACT

In a hydraulic drive system of a work machine which drives a plurality of actuators using three or more pumps, for an operation not including traveling, a highly efficient combined operation in a front implement and excellent combined operability of a swing and the front implement are enabled, while for an operation including traveling, a highly efficient traveling operation and a highly efficient combined
(Continued)

operation of traveling and the front implement are enabled, and a sufficient operation speed of the front implement is achieved. To this end, each of the flow rates of the first, second, and third pumps (101, 201, 301) can be controlled independently by performing the load sensing control, and in a combined operation for driving a boom (511) and an arm (512), ether one of them is driven by the first pump while the other one is driven by the second pump, and the swing is driven by the third pump. In the traveling operation, the maximum capacity of the first and second pumps is switched to the maximum capacity for the traveling operation and driven by an open center circuit. In a combined operation of traveling and the front implement, the front implement is driven by performing the load sensing control using the third pump.

8 Claims, 17 Drawing Sheets

(51) Int. Cl.
*F15B 11/00* (2006.01)
*F15B 11/02* (2006.01)

(52) U.S. Cl.
CPC ..... *F15B 11/02* (2013.01); *F15B 11/05* (2013.01); *F15B 2211/20546* (2013.01); *F15B 2211/20576* (2013.01); *F15B 2211/2656* (2013.01); *F15B 2211/6355* (2013.01)

(56) References Cited

U.S. PATENT DOCUMENTS

| | | | | |
|---|---|---|---|---|
| 9,879,405 | B2 * | 1/2018 | Saitoh | E02F 9/2289 |
| 2016/0115974 | A1 * | 4/2016 | Takahashi | F15B 11/17 60/421 |
| 2017/0037601 | A1 * | 2/2017 | Takahashi | F15B 11/17 |

FOREIGN PATENT DOCUMENTS

| | | | |
|---|---|---|---|
| JP | 2015-148236 | A | 8/2015 |
| JP | 2015-175491 | A | 10/2015 |
| JP | 2016-145604 | A | 8/2016 |

OTHER PUBLICATIONS

Japanese-language Written Opinion (PCT/ISA/237) issued in PCT Application No. PCT/JP2017/044981 dated Mar. 20, 2018 (four (4) pages).

International Preliminary Report on Patentability (PCT/IB/338 & PCT/IB/373) issued in PCT Application No. PCT/JP2017/044981 dated Jun. 27, 2019, including English translation of document C2 (Japanese-language Written Opinion (PCT/ISA/237) previously filed on Feb. 20, 2019) (nine (9) pages).

* cited by examiner

TABLE 5

TABLE 7

TABLE 6

HYDRAULIC DRIVE SYSTEM OF WORK MACHINE

TECHNICAL FIELD

The present invention relates to a hydraulic drive system of a work machine such as a hydraulic excavator, and particularly to a hydraulic drive system of a work machine for performing what is called load sensing control which drives a plurality of actuators using three or more pumps, and controls at least one of the plurality of pumps such that a delivery pressure of the pump becomes higher than a maximum load pressure of the plurality of actuators by a given set pressure.

BACKGROUND ART

Several hydraulic drive systems have been proposed for a work machine such as a hydraulic excavator. These hydraulic drive systems each include a plurality of main pumps, and perform load sensing control of at least one of the plurality of main pumps to achieve both excellent combined operability and energy saving.

For example, Patent Document 1 proposes a following structure.

A hydraulic drive system of a work machine such as a hydraulic excavator includes first and second pumps constituted by two delivery ports of a split flow type pump of a variable displacement type, and a third pump of a fixed displacement type. During non-traveling operation, the hydraulic drive system combines hydraulic fluids of the first and second pumps, and supplies the fluids to a front implement actuator to perform load sensing control. During swing operation, the hydraulic drive system supplies a hydraulic fluid of the third pump of the fixed displacement type to a swing motor via an open center circuit. In case of an operation for traveling only, or a simultaneous operation for operating actuators other than the front implement, such as operation for traveling and swing, the hydraulic fluids of the first and second pumps are supplied to left and right traveling motors via the open center circuit, while the hydraulic fluid of the third pump is supplied to the swing motor via the open center circuit. In case of a combined operation for traveling and the front implement, the hydraulic fluids of the first and second pumps are supplied to the left and right traveling motors, while the hydraulic fluid of the third pump is supplied to the front implement actuators. The hydraulic fluids in the combined operation are supplied via corresponding pressure compensating valves and flow control valves to perform split flow control using the pressure compensating valves.

Patent Document 2 proposes a following structure.

A hydraulic drive system of a work machine such as a hydraulic excavator includes first and second pumps constituted by two delivery ports of a split flow type pump of a variable displacement type, and a third pump of a variable displacement type. Each of the first and second pumps and the third pump is configured to perform load sensing control. Torque of the third pump is detected by approximation using two pressure reducing valves, and fed back to the first and second pumps. A hydraulic fluid of the third pump is used for main driving of a boom cylinder, while a hydraulic fluid of the first pump is used for assist driving of the boom cylinder. A hydraulic fluid of the second pump is used for main driving of an arm cylinder, while a hydraulic fluid of the first pump is used for assist driving of the arm cylinder.

PRIOR ART DOCUMENT

Patent Documents

Patent Document: JP-2001-355257-A
Patent Document: JP-2015-148236-A

SUMMARY OF THE INVENTION

Problems to be Solved by the Invention

According to a technology described in Patent Document 1, an operation not including traveling (work with its undercarriage stopped) such as excavation and leveling work (e.g., horizontally leveling operation) using the front implement, can be performed forcefully and smoothly by utilizing load sensing control.

Moreover, according to the technology described in Patent Document 1, for performing a combined operation combining swing and the front implement as an operation not including traveling, swing and the front implement are driven by using different pumps (third pump for swing, and first and second pumps for front implement). Accordingly, excellent combined operability for swing and the front implement is achievable without causing speed interference between swing and the front implement.

For straight traveling or traveling combined operation as an operation including traveling, a traveling motor is driven by an open center circuit without producing a meter-in loss (differential pressure at meter-in opening of main spool, i.e., load sensing differential pressure) at a pressure compensating valve required for load sensing control. Accordingly, a highly efficient traveling operation is achievable.

According to the technology of Patent Document 1, however, the pressure compensating valve of the arm cylinder, which is a large flow rate actuator, is restricted for performing a combined operation combining the light-load arm and the heavy-load boom as an operation not including traveling, such as leveling/pushing operation using the boom and the arm. In this case, a restricting pressure loss at the pressure compensating valve produces a large meter-in loss, wherefore a highly efficient combined operation is difficult to achieve.

For performing a combined operation combining traveling and the front implement as an operation including traveling (e.g., combined operation of traveling and boom raising), a large bleed-off loss is produced by discharge of a surplus flow amount from an unloading valve when a required flow rate is small in correspondence with a small operation amount of the front implement in case of the third pump constituted by the fixed displacement type. Accordingly, a highly efficient combined operation of traveling and the front implement is difficult to achieve.

Moreover, the third pump is of the fixed displacement type in Patent Document 1. In this case, the capacity of the third pump needs to be set in accordance with an actuator driven by the third pump and requiring only a small flow rate, such as swing and a blade. Accordingly, a sufficient operation speed of the front implement is difficult to obtain at the time of the combined operation of traveling and the front implement as an operation including traveling (e.g., combined operation of traveling and boom raising).

According to the technology described in Patent Document 2, torque of the third pump is accurately detected by using a pure hydraulic system, and fed back to the first and second pumps. Accordingly, output torque of a prime mover is effectively utilized by accurate entire torque control.

According to the technology descried in Patent Document 2, for performing an operation requiring half-lever operation of the boom and full-lever operation of the arm, such as a leveling operation as an operation not including traveling, the boom and the arm are driven by hydraulic fluids delivered from different pumps (delivery ports). In this case, a large meter-in loss is not produced at the pressure compensating valve for the arm which is a low-load side actuator, unlike a configuration which splits hydraulic fluid supplied from one pump (delivery port) into flows for the boom and for the arm by using a pressure compensating valve. Accordingly, a highly efficient combined operation is achievable.

For performing a traveling combined operation combining traveling and boom raising with a small operation amount as an operation including traveling, the third pump also performs load sensing control and delivers only a necessary flow. In this case, a breed-off loss produced by discharge of a surplus flow from the unloading valve is suppressed, wherefore efficient work is achievable.

According to the technology of Patent Document 2, however, for performing a combined operation combining swing and arm operation as an operation not including traveling, swing and arm are connected to the same pump (delivery port) and driven. Accordingly, speed interference between the arm and swing may be caused, in which condition a time may be required for mastering work.

For straight traveling or a traveling combined operation as an operation including traveling, load sensing control is performed at the first pump (first delivery port) and the second pump (second delivery port). In this case, a meter-in loss (differential pressure at meter-in opening of main spool, i.e., load sensing differential pressure) is produced at the pressure compensating valve for traveling. Accordingly, a highly efficient traveling operation is difficult to achieve.

According to the structure of Patent Document 2, the boom cylinder is driven by the first pump (sub) and the third pump (main), while the arm cylinder is driven by the first pump (sub) and the second pump (main). The left and right traveling motors are driven by the first and second pumps (combined flow). Accordingly, for a combined operation combining traveling and the front implement as an operation including traveling (e.g., combined operation of traveling and boom raising or traveling and arm crowding), most of delivery fluids of the first and second pumps are supplied to the traveling motor. In this case, a sufficient flow rate of hydraulic fluid is difficult to supply to the boom cylinder or the arm cylinder. Accordingly, a sufficient operation speed of the front implement is difficult to obtain similarly to Patent Document 1.

An object of the present invention is to provide a hydraulic drive system of a work machine for driving a plurality of actuators using three or more pumps, wherein in an operation not including traveling, a bleed-off loss of an unloading valve and a meter-in loss by a pressure compensating valve are reduced so that a highly efficient combined operation in a front implement can be achieved while allowing excellent combined operability of swing and the front implement to be achieved, and in an operation including traveling, a highly efficient traveling operation can be achieved without producing a meter-in loss by a load sensing differential pressure while a bled-off loss of the unloading valve is reduced so that a highly efficient combined operation of traveling and the front implement can be achieved while allowing a sufficient operation speed of the front implement to be attained.

Means for Solving the Problems

In order to solve the problems described above, according to the present invention, there is provided a hydraulic drive system of a work machine, the hydraulic drive system comprising a plurality of actuators including left and right traveling motors that drive left and right traveling devices, respectively, and a boom cylinder, an arm cylinder, and a swing motor that drive a boom, an arm, and a swing device, respectively; a plurality of first flow control valves of a closed center type connected to a plurality of first actuators that include the boom cylinder and the arm cylinder in the plurality of actuators but do not include the left and right traveling motors; a plurality of second flow control valves of an open center type connected to a plurality of second actuators that include the left and right traveling motors; a plurality of third flow control valves connected to a plurality of third actuators that include the swing motor in the plurality of actuators but do not include the left and right traveling motors; a plurality of pressure compensating valves that control flow rates of hydraulic fluids supplied to the plurality of first flow control valves; first and second pumps that supply hydraulic fluids to the plurality of first and second flow control valves, and a third pump that supplies hydraulic fluids to the plurality of first and third flow control valves; a delivery rate control device that changes delivery rates of the first and second pumps; a traveling operation detection device that detects a traveling operation for driving the left and right traveling motors; a selector valve device that lies at a first position for introducing hydraulic fluids delivered from the first and second pumps to the plurality of first flow control valves when the traveling operation detection device does not detect the traveling operation, and switches to a second position for introducing hydraulic fluids delivered from the first and second pumps to the plurality of second flow control valves and introducing hydraulic fluids delivered from the third pump to the plurality of first flow control valves when the traveling operation detection device detects the traveling operation, wherein: the plurality of third flow control valves connected to the plurality of third actuators are flow control valves of a closed center type; the plurality of pressure compensating valves include a plurality of pressure compensating valves that control flow rates of hydraulic fluids supplied to the plurality of third flow control valves; the third pump has a maximum capacity set such that a necessary flow rate can be supplied to an actuator requiring a largest flow rate in the plurality of first actuators; the delivery rate control device includes first, second, and third delivery rate control devices that individually change delivery rates of the first, second, and third pumps, respectively; the first and second delivery rate control devices are configured to perform load sensing control such that delivery pressures of the first and second pumps become higher than a maximum load pressure of respective actuators driven by delivery fluids of the first and second pumps in the plurality of first actuators by a given set value when the traveling operation detection device does not detect the traveling operation and the selector valve device is located at the first position, and stop the load sensing control of the first and second pumps and drive the plurality of second actuators when the traveling operation detection device detects the traveling operation and the selector valve device switches to the second position; the third delivery rate control device is configured to perform load sensing control such that a delivery pressure of the third pump becomes higher than a maximum load pressure of the plurality of third actuators by a given set value when the traveling operation detection device does not detect the traveling operation and the selector valve is located at the first position, and perform load sensing control such that the delivery pressure of the third pump becomes higher than a maximum load pressure of the plurality of first and third actuators by a given set value when the traveling operation detection device detects the traveling operation and the selector valve device switches to the second position.

According to the present invention thus configured, in the operation not including traveling operation such as excavation work and leveling work using the front implement, since the selector valve device lies at the first position and the first and second delivery rate control devices perform load sensing control such that the delivery pressures of the first and second pumps each become higher than the maximum load pressure of the respective actuators driven by the delivery fluids of the first and second pumps in the plurality of first actuators by a given set value, a bleed-off loss and a meter-in loss produced by the pressure compensating valves of the low-load side actuators are reduced so that a highly efficient combined operation in the front implement can be performed.

In the combined operation combining swing and the front implement, since the third delivery rate control device performs load sensing control such that the delivery pressure of the third pump becomes higher than the maximum load pressure of the plurality of third actuators including the swing motor by a given set value and the swing motor and the front implement actuator are driven by the different pumps (third pump for swing motor, and first and second pumps for front implement actuator), speed interference between swing and the front implement in a combined operation of traveling and the front implement is suppressed so that excellent combined operability can be achieved.

In the operation including traveling, since the selector valve device switches to the second position and the first and second delivery rate control devices stop load sensing control of the first and second pumps and drive the plurality of second actuators including the left and right traveling motors, a highly efficient traveling operation can be achieved without producing a meter-in loss by a load sensing differential pressure.

Since the third delivery rate control device performs load sensing control such that the delivery pressure of the third pump becomes higher than the maximum load pressure of the plurality of first and third actuators by a given set value, in the combined operation of traveling and the front implement, a bleed-off loss produced by an unloading valve is reduced so that a highly efficient combined operation can be achieved. Moreover, since the maximum capacity of the third pump is set on the basis of the actuator requiring the largest flow rate in the plurality of first actuators including the boom cylinder and the arm cylinder, a sufficient operation speed of the front implement is attained so that an excellent combined operation can be achieved.

Advantages of the Invention

According to the present invention, following advantages are offered.

(1) In an operation not including traveling such as excavation work and leveling work, a bleed-off loss and a meter-in loss produced by a pressure compensating valve of a low-load side actuator are reduced so that a highly efficient combined operation in a front implement can be performed while speed interference between swing and the front implement in a combined operation of traveling and the front implement is suppressed so that excellent combined operability can be achieved.

(2) In an operation including traveling, a highly efficient traveling operation can be achieved without producing a meter-in loss by a load sensing differential pressure, and in a combined operation of traveling and the front implement, a bleed-off loss produced by an unloading valve is reduced so that a highly efficient combined operation can be achieved and a sufficient operation speed of the front implement is attained so that an excellent combined operation can be achieved.

MODES FOR CARRYING OUT THE INVENTION

Embodiments of the present invention will be hereinafter described with reference to the drawings.

Embodiment 1

~Structure~

Figure 1:
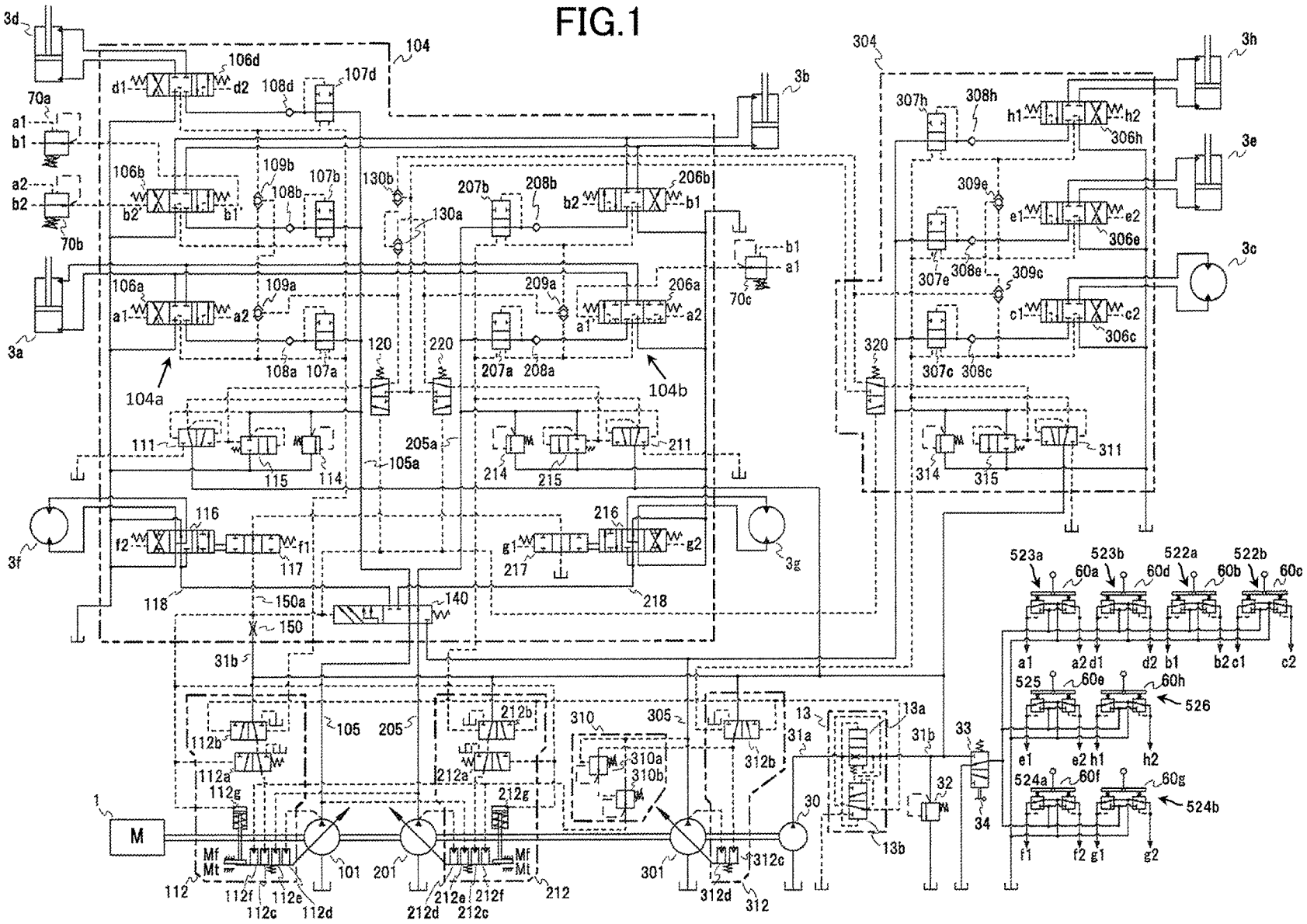
FIG. 1 is a diagram showing a general structure of a hydraulic drive system of a work machine according to Embodiment 1 of the present invention.
Figure 1A:
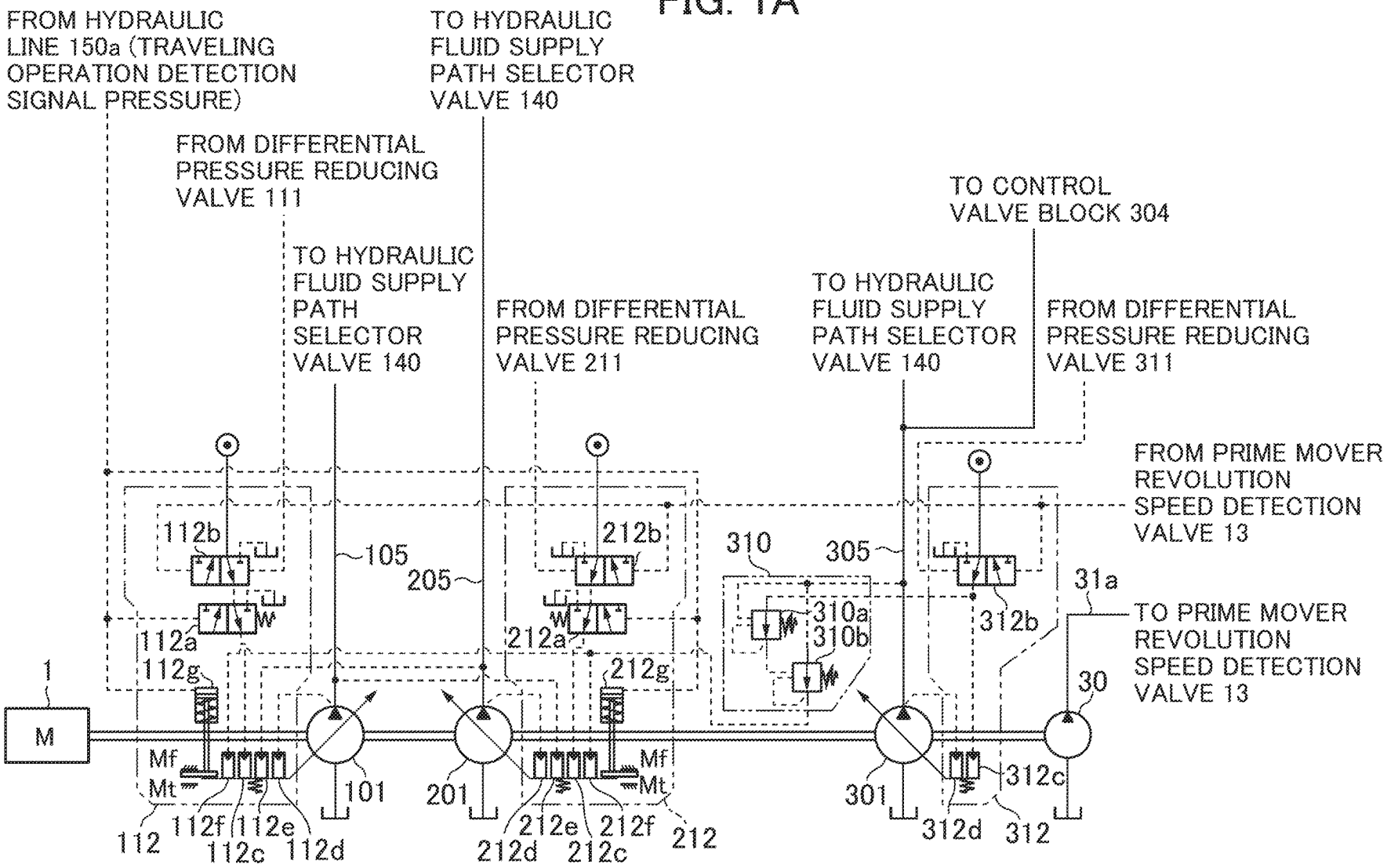
FIG. 1A is a divisional enlarged diagram of a pump section of the hydraulic drive system shown in FIG. 1.
Figure 1B:
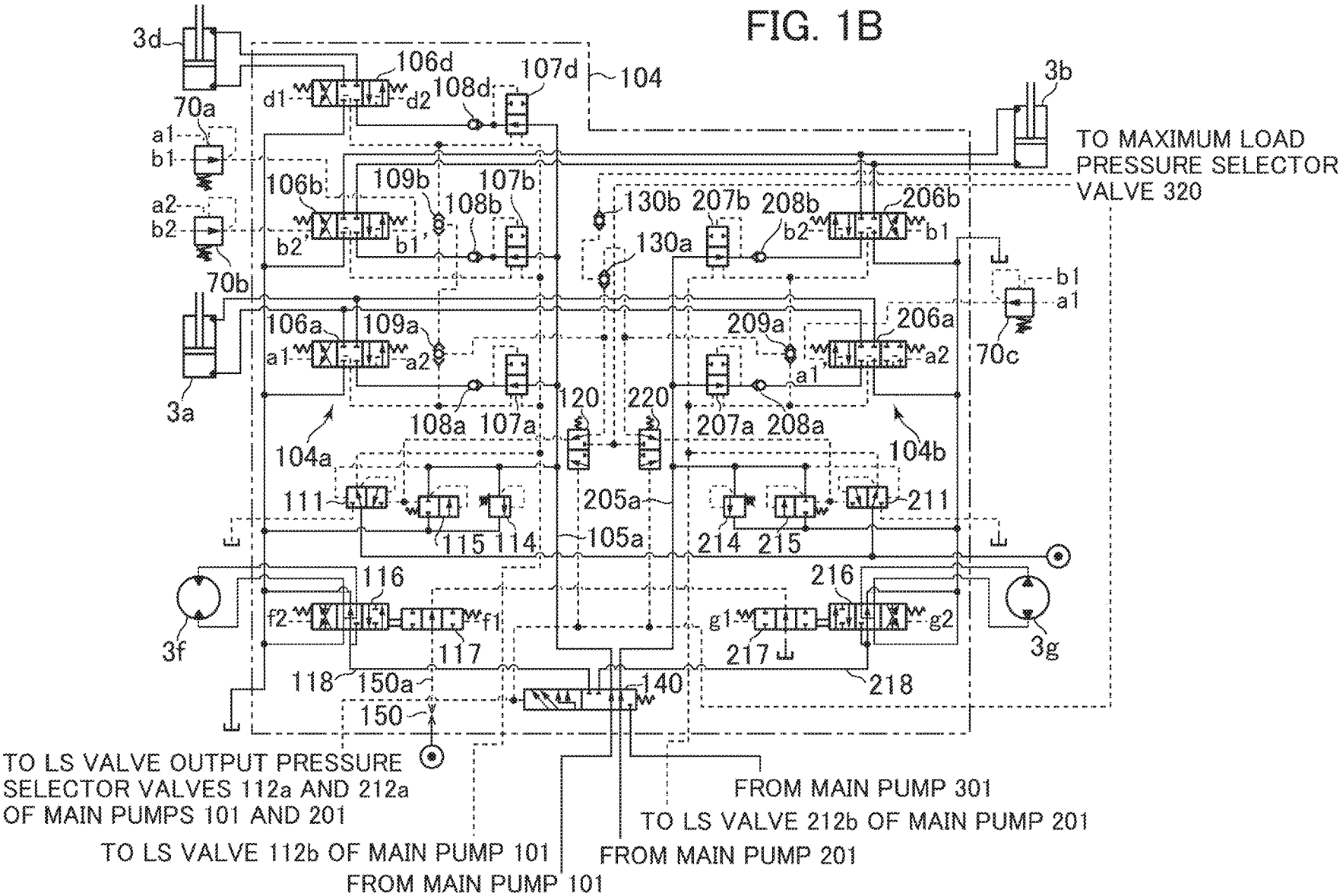
FIG. 1B is a divisional enlarged diagram of a first control valve block of the hydraulic drive system shown in FIG. 1.
Figure 1C:
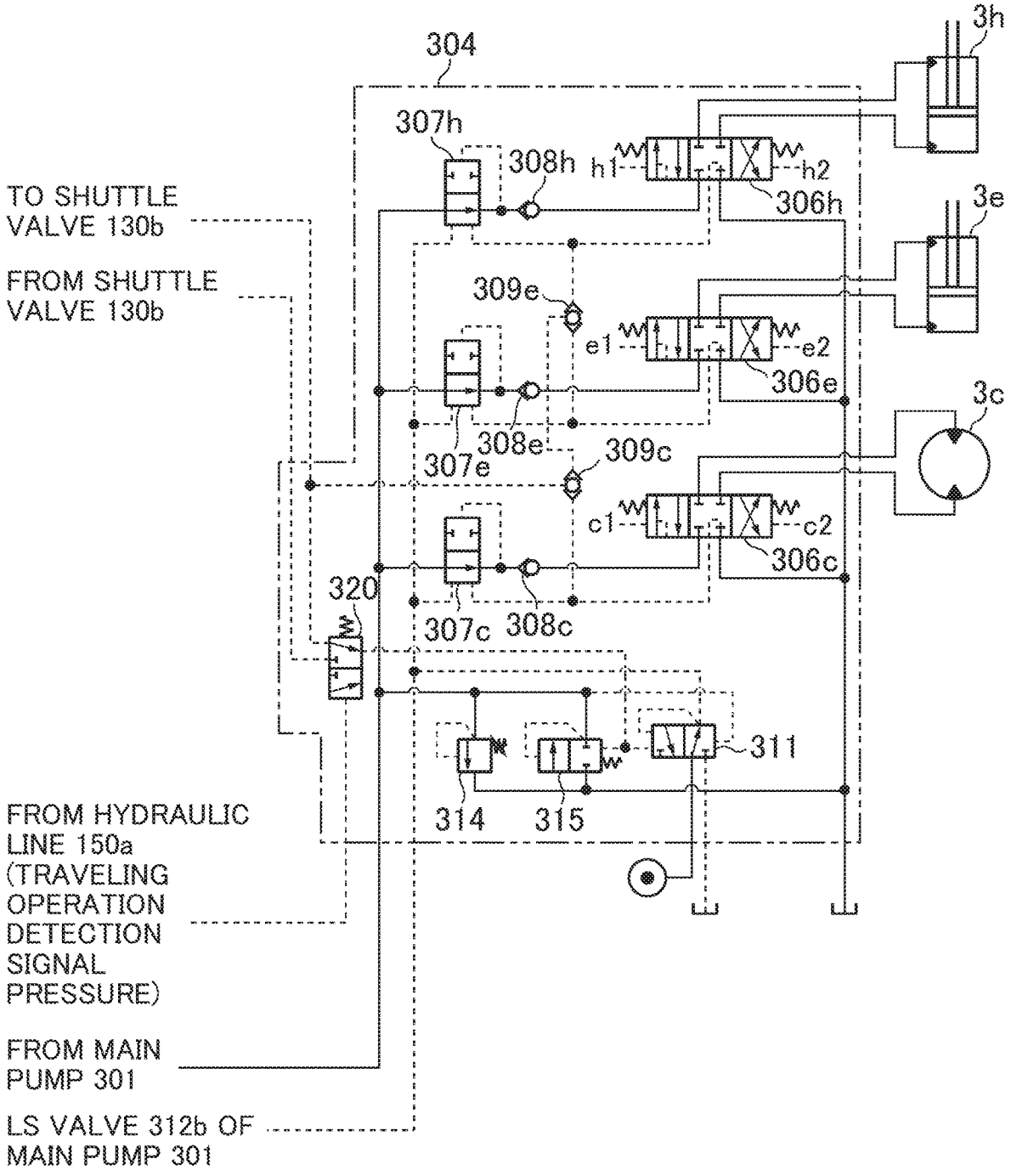
FIG. 1C is a divisional enlarged diagram of a second control valve block of the hydraulic drive system shown in FIG. 1.

FIG. 1 is a diagram showing a general structure of a hydraulic drive system of a work machine according to Embodiment 1 of the present invention. FIG. 1A is a divisional enlarged diagram of a pump section of the hydraulic drive system shown in FIG. 1. FIG. 1B is a divisional enlarged diagram of a first control valve block of the hydraulic drive system shown in FIG. 1. FIG. 1C is a divisional enlarged diagram of a second control valve block of the hydraulic drive system shown in FIG. 1.

The hydraulic drive system includes a prime mover 1 (diesel engine), main pumps 101, 201, and 301 of a variable displacement type (first, second, and third pumps) and a pilot pump 30 of a fixed displacement type, both types driven by the prime mover 1, a regulator 112 (first delivery rate control device) for controlling a delivery rate of the main pump 101, a regulator 212 (second delivery rate control device) for controlling a delivery rate of the main pump 201, a regulator 312 (third delivery rate control device) for controlling a delivery rate of the main pump 301, a boom cylinder 3*a*, an arm cylinder 3*b*, a swing motor 3*c*, a bucket cylinder 3*d*, a swing cylinder 3*e*, traveling motors 3*f* and 3*g*, and a blade cylinder 3*h* as a plurality of actuators driven by hydraulic fluids delivered from the main pumps 101, 201, and 301, hydraulic fluid supply paths 105, 205, and 305 for introducing the hydraulic fluids delivered from the main pumps 101, 201, and 301 to the plurality of actuators, a first control valve block 104 disposed downstream of the hydraulic fluid supply paths 105 and 205 as a block to which the hydraulic fluids delivered from the main pumps 101 and 201 are introduced, and a second control valve block 304 disposed downstream of the hydraulic fluid supply path 305 as a block to which the hydraulic fluid delivered from the main pump 301 is introduced.

The first control valve block 104 is configured as follows.

A hydraulic fluid supply path selector valve 140 (hereinafter abbreviated as selector valve) (selector valve device) for switching the hydraulic fluid supply paths 105 and 205 of the main pumps 101 and 102 is included in the first control valve block 104. A plurality of flow control valves 106*a*, 106*b*, and 106*d* of a closed center type (a plurality of first flow control valves) for controlling the boom cylinder 3*a*, the arm cylinder 3*b*, and the bucket cylinder 3*d* (a plurality of first actuators), a hydraulic fluid supply path 105*a* for introducing the hydraulic fluid of the main pump 101 to the plurality of flow control valves 106*a*, 106*b*, and 106*d*, a plurality of flow control valves 206*a* and 206*b* (a plurality of first flow control valves) of a closed center type for controlling the boom cylinder 3*a* and the arm cylinder 3*b* (a plurality of first actuators), a hydraulic fluid supply path 205*a* for introducing the hydraulic fluid of the main pump 201 to the plurality of flow control valves 206*a* and 206*b*, a directional control valve 116 of an open center type (one of second flow control valves) for controlling the traveling motor 3*f* (one of the plurality of second actuators), a hydraulic fluid supply path 118 for introducing the hydraulic fluid of the main pump 101 to the directional control valve 116, a directional control valve 216 of an open center type (the other of second flow control valves) for controlling the traveling motor 3*g* (the other of the plurality of second actuators), and a hydraulic fluid supply path 218 for introducing the hydraulic fluid of the main pump 201 to the directional control valve 216 are provided downstream of the selector valve 140.

The selector valve 140 in neutral is configured to lie at a first position to connect the hydraulic fluid supply paths 105 and 205 to the hydraulic fluid supply paths 106*a* and 205*a*, respectively. The selector valve 140 at the time of switching switches to a second position to connect the hydraulic fluid supply path 105 to the hydraulic fluid supply path 118 extending toward the directional control valve 216, connect the hydraulic fluid supply path 205 to the hydraulic fluid supply path 218 extending toward the directional control valve 216, and connect the hydraulic fluid supply path 305 to the hydraulic fluid supply paths 105*a* and 205*a*.

Pressure compensating valves 107*a*, 107*b*, and 107*d* for controlling flow rates of the flow control valves 106*a*, 106*b*, and 106*d*, check valves 108*a*, 108*b*, and 108*d*, a main relief valve 114 for controlling to maintain a pressure P1 of the hydraulic fluid supply path 105*a* at a pressure lower than a set pressure, an unloading valve 115 which comes into an opened state to return the hydraulic fluid of the hydraulic fluid supply path 105*a* to a tank when the pressure P1 of the hydraulic fluid supply path 105*a* becomes equal to or higher than a maximum load pressure Plmax1 of the plurality of actuators 3*a*, 3*b*, and 3*d* (during traveling, maximum load pressure Plmax0 of all actuators 3*a*, 3*b*, 3*c*, 3*d*, 3*e*, 3*h* other than actuators for traveling) by equal to or higher than a predetermined pressure, and a differential pressure reducing valve 111 which outputs a differential pressure between the pressure P1 of the hydraulic fluid supply path 105*a* and the maximum load pressure Plmax1 of the plurality of actuators 3*a*, 3*b*, and 3*d* (during traveling, maximum load pressure Plmax0 of all actuators 3*a*, 3*b*, 3*c*, 3*d*, 3*e*, and 3*h* other than actuators for traveling) as an absolute pressure Pls1 are provided in the hydraulic fluid supply path 105*a*.

Pressure compensating valves 207*a* and 207*b* for controlling flow rates of the flow control valves 206*a* and 206*b*, check valves 208*a* and 208*b*, a main relief valve 214 for maintaining a pressure P2 of the hydraulic fluid supply path 205*a* at a pressure lower than a set pressure, an unloading valve 215 which comes into an opened state to return the hydraulic fluid of the hydraulic fluid supply path 205*a* to the tank when the pressure P2 of the hydraulic fluid supply path 205*a* becomes equal to or higher than a maximum load pressure Plmax2 of the plurality of actuators 3*a* and 3*b* (during traveling, maximum load pressure Plmax0 of all actuators 3*a*, 3*b*, 3*c*, 3*d*, 3*e*, 3*h* other than actuators for traveling) by equal to or higher than a predetermined pressure, and a differential pressure reducing valve 211 which outputs a differential pressure between the pressure P2 of the hydraulic fluid supply path 205*a* and the maximum load pressure Plmax2 of the plurality of actuators 3*a* and 3*b* (during traveling, maximum load pressure Plmax0 of all actuators 3*a*, 3*b*, 3*c*, 3*d*, 3*e*, and 3*h* other than actuators for traveling) as an absolute pressure Pls2 are provided in the hydraulic fluid supply path 205*a*.

Shuttle valves 109*a* and 109*b* for detecting the maximum load pressure Plmax1 of the plurality of actuators 3*a*, 3*b*, and 3*d*, a maximum load pressure selector valve 120 (hereinafter abbreviated as selector valve) for switching such that the maximum load pressure Plmax0 of all the actuators 3*a*, 3*b*, 3*c*, 3*d*, 3*e*, and 3*h* other than actuators for traveling is input to the unloading valve 115 and the differential pressure reducing valve 111 instead of Plmax1 during traveling operation, a shuttle valve 209*a* for detecting the maximum load pressure Plmax2 of the plurality of actuators 3*a* and 3*b*, a maximum load pressure selector valve 220 (hereinafter abbreviated as selector valve) for switching such that the maximum load pressure Plmax0 of all the actuators 3*a*, 3*b*, 3*c*, 3*d*, 3*e*, and 3*h* other than actuators for traveling is input to the unloading valve 215 and the differential pressure reducing valve 211 instead of Plmax2 during traveling operation, shuttle valves 130*a* and 130*b* for detecting the maximum load pressure Plmax0 of all the actuators 3*a*, 3*b*, 3*c*, 3*d*, 3*e*, and 3*h* other than actuators for traveling, and signal selector valves 117 and 217 (traveling operation detection device) formed integrally with spools of the directional control valves 116 and 216 for controlling the traveling motors 3*f* and 3*g*, and switching in conjunction with the directional control valves 116 and 216 are further provided included in the first control valve block 104.

The shuttle valves 190*a* and 109*b* are connected to load pressure detection ports of the flow control valves 106*a*, 106*b* and 106*d*, and select and output the highest load pressure in the detected load pressures as Plmax1. When the flow control valves 106*a*, 106*b*, and 106*d* are located at neutral positions, the load pressure detection ports of the flow control valves 106*a*, 106*b*, and 106*d* are connected to the tank to output a tank pressure as a load pressure. When the positions of the flow control valves 106*a*, 106*b*, and 106*d* are switched from the neutral positions, the load pressure detection ports are connected to actuator lines of the actuators 3*a*, 3*b*, and 3*d* to output load pressures of the respective actuators 3*a*, 3*b*, and 3*d*.

Similarly, the shuttle valves 209*a* is connected to load pressure detection ports of the flow control valves 206*a* and 206*b*, and selects and outputs the highest load pressure in the detected load pressures as Plmax2. When the flow control valves 206*a* and 206*b* are located at neutral positions, the load pressure detection ports of the flow control valves 206*a* and 206*b* are connected to the tank to output the tank pressure as a load pressure. When the positions of the flow control valves 206*a* and 206*b* are switched from the neutral positions, the load pressure detection ports are connected to actuator lines of the actuators 3*a* and 3*b* to output load pressures of the actuators 3*a* and 3*b*.

Meanwhile, a plurality of flow control valves 306*c*, 306*e*, and 306*h* of a closed center type (a plurality of third flow control valves) for controlling the swing motor 3*c*, the swing cylinder 3*e*, and the blade cylinder 3*h* (a plurality of third actuators), pressure compensating valves 307*c*, 307*e*, and 307*h* for controlling flow rates of fluids flowing in the flow control valves 306*c*, 306*e*, and 306*h* (third flow control valves), and check valves 308*c*, 308*e*, and 308*h* are included in the second control valve block 304 on the downstream of the hydraulic fluid supply path 305 of the main pump 301. A main relief valve 314 for maintaining a pressure P3 of the hydraulic fluid supply path 305 at a pressure lower than a set pressure, shuttle valves 309*c* and 309*e* for detecting a maximum load pressure Plmax3 of the plurality of actuators 3*c*, 3*e*, and 3*h*, an unloading valve 315 which comes into an opened state and returns the hydraulic fluid of the hydraulic fluid supply path 305 to the tank when the pressure P3 of the hydraulic fluid supply path 305 becomes equal to or higher than the maximum load pressure Plmax3 of the plurality of actuators 3*c*, 3*e*, and 3*h* (during traveling, maximum load pressure Plmax0 of all actuators 3*a*, 3*b*, 3*c*, 3*d*, 3*e*, and 3*h* other than actuators for traveling) by equal to or higher than a predetermined pressure, a differential pressure reducing valve 311 which outputs a differential pressure between the pressure P3 of the hydraulic fluid supply path 305 and the maximum load pressure Plmax3 of the plurality of actuators 3*c*, 3*e*, and 3*h* (during traveling, maximum load pressure Plmax0 of all actuators 3*a*, 3*b*, 3*c*, 3*d*, 3*e*, and 3*h* other than actuators for traveling) as an absolute pressure Pls3, and a maximum load pressure selector valve 320 (hereinafter abbreviated as selector valve) for switching such that the maximum load pressure Plmax0 of all the actuators 3*a*, 3*b* 3*c*, 3*d*, 3*e*, and 3*h* other than actuators for traveling is input to the unloading valve 315 and the differential pressure reducing valve 311 during traveling operation instead of Plmax3 are further provided in the second control valve block 304.

The shuttle valves 309*c* and 309*e* are connected to load pressure detection ports of the flow control valves 306*c*, 306*e*, and 306*h*, and select and output the highest load pressure in the detected load pressures as Plmax3. When the flow control valves 306*c*, 306*e*, and 306*h* are located at neutral positions, the load pressure detection ports of the flow control valves 306*c*, 306*e*, and 306*h* are connected to the tank to output a tank pressure as a load pressure. When the positions of the flow control valves 306*c*, 306*e*, and 306*h* are switched from the neutral positions, the load pressure detection ports are connected to actuator lines of the actuators 3*c*, 3*e*, and 3*h* to output load pressures of the respective actuators 3*c*, 3*e*, and 3*h*, respectively.

The hydraulic fluid delivered from the pilot pump 30 of the fixed displacement type passes through a prime mover revolution speed detection valve 13, whereby a fixed pilot pressure Pi0 is generated by a pilot relief valve 32. The prime mover revolution speed detection valve 13 includes a variable restrictor 13*a*, and a differential pressure reducing valve 13*b* which outputs a differential pressure between inlet and outlet of the prime mover revolution speed detection valve as a target LS differential pressure Pgr.

A plurality of pilot valves 60*a*, 60*b*, 60*c*, 60*d*, 60*e*, 60*f*, 60*g*, and 60*h* for generating operation pressures a1, a2; b1, b2; c1, c2; d1, d2; e1, e2; f1, f2; g1, g2; and h1, h2 for controlling the plurality of flow control valves 106*a*, 106*b*, 106*d*, 206*a*, 206*b*, 306*c*, 306*e*, and 306*h*, and the plurality of directional control valves 116 and 216, and a selector valve 33 for switching between connection between the pilot primary pressure Pi0 generated by the pilot relief valve 32 and the plurality of pilot valves 60*a*, 60*b*, 60*c*, 60*d*, 60*e*, 60*f*, 60*g*, and 60*h*, and connection between the tank pressure and these pilot valves are disposed on the downstream of the pilot relief valve 32. The selector valve 33 is configured to switch in the manner described above by using a gate lock lever 34. The gate lock lever 34 is provided on a driver's seat of a construction machine such as a hydraulic excavator.

A maximum capacity Mf of each of the main pumps 101 and 201 (specific maximum capacity) is set on the basis of the boom cylinder 3*a* or the arm cylinder 3*b* in such a manner as to supply a necessary flow rate to the boom cylinder 3*a* or the arm cylinder 3*b* corresponding to an actuator requiring a largest flow rate in the actuators driven by the main pumps 101 and 201. Similarly to the main pumps 101 and 201, a maximum capacity the main pump 301 is set on the basis of the boom cylinder 3*a* or the arm cylinder 3*b* such that a necessary flow rate can be supplied to the boom cylinder 3*a* or the arm cylinder 3*b* corresponding to an actuator requiring a largest flow rate in the actuators driven by the main pump 301. Accordingly, a maximum capacity Ms of the main pump 301 is equivalent to the maximum capacity Mf of the main pumps 101 and 201 (Ms=Mf).

The regulator 312 of the main pump 301 of the variable displacement type includes a horsepower control piston 312*d* which receives the pressure P3 of the hydraulic fluid supply path 305 of the main pump 301, and reduces a tilt of the main pump 301 to maintain torque at a predetermined value or lower when P3 increases, a flow rate control piston 312*c* for controlling a delivery rate of the main pump 301 in accordance with required flow rates of the plurality of flow control valves 306*c*, 306*e*, and 306*h* (during traveling operation, flow control valve associated with all actuators 3*a*, 3*b*, 3*c*, 3*d*, 3*e*, and 3*h* other than actuators for traveling), and an LS valve 312*b* for introducing the fixed pilot pressure Pi0 to the flow rate control piston 312*c* to decrease the flow rate of the main pump 301 when Pls3 is higher than the target LS differential pressure Pgr, and releases the hydraulic fluid of the flow rate control piston 312*c* to the tank to increase the flow rate of the main pump 301 when Pls3 is lower than the target LS differential pressure Pgr.

The LS valve 312*b* and the flow rate control piston 312*c* provide a load sensing control section which controls the capacity of the main pump 301 such that the delivery pressure P3 of the main pump 301 becomes higher than the maximum load pressure Plmax of the actuators 3*c*, 3*e*, and 3*h* (during traveling operation, all actuators 3*a*, 3*b*, 3*c*, 3*d*, 3*e*, and 3*h* other than actuators for traveling) driven by the hydraulic fluid delivered from the main pump 301 by the target LS differential pressure Pgr.

The regulator 112 of the main pump 101 of the variable displacement type includes horsepower control pistons 112*d* and 112*e* which receive the pressure P1 of the hydraulic fluid supply path 105 of the main pump 101 and the pressure P2 of the hydraulic fluid supply path 205 of the main pump 201, and reduce tilts of the main pump 101 to maintain torque at a predetermined value or lower when P1 and P2 increase, a flow rate control piston 112*c* for controlling a delivery rate of the main pump 101 in accordance with required flow rates of the plurality of flow control valve 106*a*, 106*b*, and 106*d* connected to the downstream of the hydraulic fluid supply path 105 during non-traveling operation, a maximum capacity selector piston 112*g* for switching the maximum capacity of the main pump 101 from Mf (first value specific to main pump 101) to Mt (second value) smaller than Mf during traveling operation, an LS valve 112*b* switched to introduce the fixed pilot pressure Pi0 to the flow rate control piston 112*c* when Pls1 is higher than the target LS differential pressure Pgr, and switched to discharge the hydraulic fluid of the flow rate control piston 112*c* to the tank when Pls1 is lower than the target LS differential pressure Pgr, an LS valve output pressure selector valve 112*a* switched to introduce output of the LS valve 112*b* to the flow rate control piston 112*c* during non-traveling operation, and switched to interrupt connection between the LS valve 112*b* and the flow rate control piston 112*c* and discharge the pressure of the flow rate control piston 112*c* to the tank during traveling operation, and a horsepower control piston 112*f* which reduces a tilt of the main pump 101 to maintain torque of the main pump 101 at predetermined torque or lower when the torque of the main pump 301 increases. The horsepower control piston 112*f* receives an output pressure of a torque estimation section 310.

The LS valve 112*b* and the flow rate control piston 112*c* provide a load sensing control section which controls the capacity of the main pump 101 such that the delivery pressure P1 of the main pump 101 becomes higher than the maximum load pressure Plmax of the actuators 3*a*, 3*b*, and 3*d* driven by the hydraulic fluid delivered from the main pump 101 by the target LS differential pressure Pgr during non-traveling operation.

The regulator 212 of the main pump 201 of the variable displacement type includes horsepower control pistons 212*d* and 212*e* which receive the pressure P2 of the hydraulic fluid supply path 205 of the main pump 201 and the pressure P1 of the hydraulic fluid supply path 105 of the main pump 101, and reduce tilts of the main pumps 201 to maintain torque at a predetermined value or lower when P1 and P2 increase, a flow rate control piston 212*c* for controlling a delivery rate of the main pump 201 in accordance with required flow rates of the plurality of flow control valve 206*a* and 206*b* connected to the downstream of the hydraulic fluid supply path 205 during non-traveling operation, a maximum capacity selector piston 212*g* for switching the maximum capacity of the main pump 201 from Mf (first value specific to main pump 201) to Mt (second value) smaller than Mf during traveling operation, an LS valve 212*b* switched to introduce the fixed pilot pressure Pi0 to the flow rate control piston 212*c* when Pls2 is higher than the target LS differential pressure Pgr, and switched to release the hydraulic fluid of the flow rate control piston 212*c* to the tank when Pls2 is lower than the target LS differential pressure Pgr, an LS valve output pressure selector valve 212*a* switched to introduce output of the LS valve 212*b* to the flow rate control piston 212*c* during non-traveling operation, and switched to interrupt connection between the LS valve 212*b* and the flow rate control piston 212*c* and discharge the pressure of the flow rate control piston 212*c* to the tank during traveling operation, and a horsepower control piston 212*f* which reduces a tilt of the main pump 201 to maintain torque of the main pump 301 at predetermined torque or lower when the torque of the main pump 301 increases. The horsepower control piston 212*f* receives the output pressure of the torque estimation section 310.

The LS valve 212*b* and the flow rate control piston 212*c* provide a load sensing control section which controls the capacity of the main pump 201 such that the delivery pressure P2 of the main pump 201 becomes higher than the maximum load pressure Plmax of the actuators 3*a* and 3*b* driven by the hydraulic fluid delivered from the main pump 201 by the target LS differential pressure Pgr during non-traveling operation.

The torque estimation section 310 is a section for estimating torque of the main pump 301 which performs load sensing control. Pressure reducing valves 310*a* and 310*b* are provided on the torque estimation section 310 in such a manner as to introduce output of the pressure reducing valve 310*a* to a set pressure change input section of the pressure reducing valve 310*b*. In addition, the delivery pressure P3 of the main pump 301 is introduced to an input of the pressure reducing valve 310*b* and a set pressure change input section of the pressure reducing valve 310*a*, while the pressure of the flow rate control piston 312*c* is introduced to an input section of the pressure reducing valve 310*a*. An operation principle of this structure of the torque estimation section 310 for estimating torque of the main pump 301 is detailed in Patent Document 2 (JP-2015-148236-A).

A restrictor 150 (traveling operation detection device) and a pilot pressure signal hydraulic line 150*a* (traveling operation detection device) are included in the first control valve block 104. The fixed pilot pressure Pi0 is introduced to the tank via the restrictor 150 through the signal selector valves 117 and 217. The signal selector valves 117 and 217 are configured to bring a hydraulic line discharged to the tank from the restrictor 150 via the signal selector valves 117 and 217 into a communication position when the directional control valves 116 and 216 for controlling the left and right traveling motors 3*f* and 3*g* are in neutral, and configured to switch the hydraulic line to an interruption position when at least either one of the directional control valves 116 and 216 is switched.

The hydraulic fluid of the signal hydraulic line 150*a* is introduced to each of the maximum load pressure selector valves 120, 220, and 320 described above, the hydraulic fluid supply path selector valve 140, the LS valve output pressure selector valves 112*a* and 212*a*, and the maximum capacity selector pistons 112*g* and 212*g*.

Moreover, the hydraulic fluids from output ports of the flow control valves 106*a* and 206*a* are combined and introduced to the boom cylinder 3*a*, while the hydraulic fluids from output ports of the flow control valves 106*a* and 206*b* are combined and introduced to the arm cylinder 3*b*.

The boom flow control valves 106*a* and 206*a* are configured such that the flow control valve 106*a* is used for main driving, and that the flow control valve 206*a* is used for assist driving. The arm flow control valves 106*b* and 206*b* are configured such that the flow control valve 206*b* is used for main driving, and that the flow control valve 106*b* is used for assist driving.

Figure 3B:
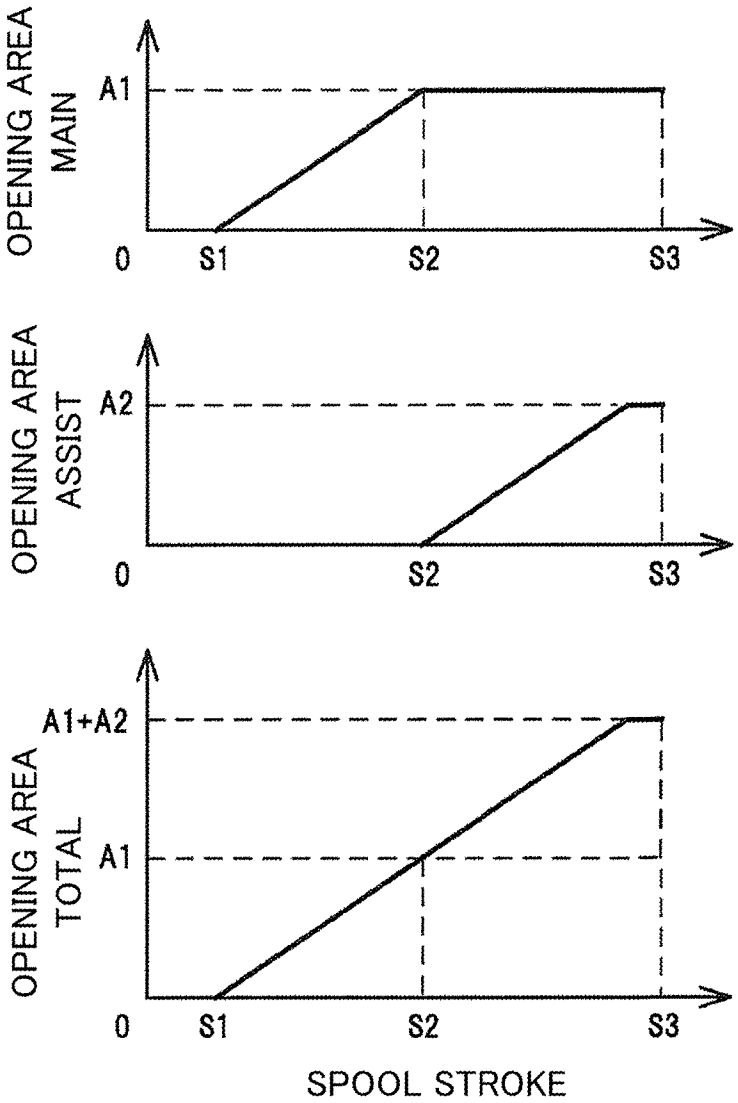
FIG. 3B is a chart showing an opening area characteristic of a meter-in path of the boom flow control valve during boom raising operation, and an opening area characteristic of a meter-in path of the arm flow control valve during arm crowding or dumping operation.
Figure 3A:
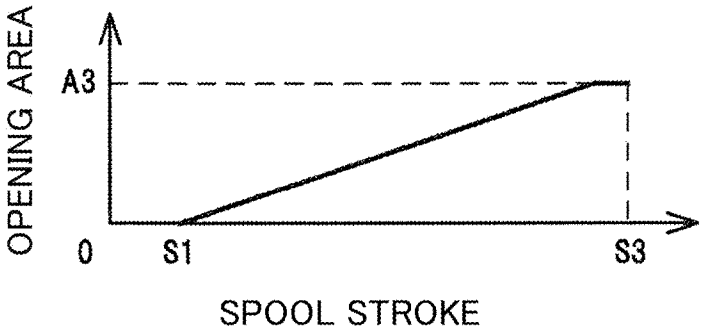
FIG. 3A is a chart showing an opening area characteristic of a meter-in path of a flow control valve of a closed center type other than a boom flow control valve and an arm flow control valve.

FIG. 3A is a chart showing an opening area characteristic of a meter-in path of each of the flow control valves 106*d*, 306*c*, 306*e*, and 306*h* of a closed center type other than the boom flow control valves 106*a* and 206*a* and the arm flow control valves 106*b* and 206*b*.

The opening area characteristic of the meter-in path of each of the flow control valves 106*d*, 306*c*, 306*e*, and 306*h* is set such that the opening area of the meter-in path increases as a spool stroke increases in excess of a dead zone 0-S1, and becomes a maximum opening area A3 immediately before a maximum spool stroke S3. The maximum opening area A3 has a size specific to each type of actuators.

FIG. 3B is a chart showing an opening area characteristic of the meter-in path of each of the boom flow control valves 106*a* and 206*a* during boom raising operation, and an opening area characteristic of the meter-in path of each of the arm flow control valves 106*b* and 206*b* during arm crowding or dumping operation.

The opening area characteristic of the meter-in path of each of the boom flow control valve 106*a* for main driving and the arm flow control valve 206*b* for main driving is set such that the opening area of the meter-in path increases as the spool stroke increases in excess of the dead zone 0-S1, and reaches a maximum opening area A1 at an intermediate stroke S2. The maximum opening area A1 is thereafter maintained until a maximum spool stroke S3.

The opening area characteristic of the meter-in path of each of the boom flow control valve 206*a* for assist driving and the arm flow control valve 106*b* for assist driving is set such that the opening area of the meter-in path is kept zero until the spool stroke reaches the intermediate stroke S2. The opening area increases with an increase in the spool stroke in excess of the intermediate stroke S2, and becomes a maximum opening area A2 immediately before the maximum spool stroke S3.

When the respective opening area characteristics of the meter-in paths of the boom flow control valves 106*a* and 206*a* and the arm flow control valves 106*b* and 206*b* are set in this manner, a synthesis opening area characteristic shown in a lower part of FIG. 3B is obtained from these characteristics.

Specifically, according to the synthesis opening area characteristic of the boom flow control valves 106*a* and 206*a* and the synthesis opening area characteristic of the arm flow control valves 106*b* and 206*b*, the opening area increases as the spool stroke increases in excess of the dead zone 0-S1. The opening area reaches a maximum opening area A1+A2 immediately before the maximum spool stroke S3.

The maximum opening area A3 of the flow control valves 106*d*, 306*c*, 306*e*, and 306*h* shown in FIG. 3A, and the synthesized maximum opening area A1+A2 of the flow control valves 106*a* and 206*a* or the flow control valves 106*b* and 206*b* shown in FIG. 3B have a relationship of A1+A2>A3. Accordingly, each of the boom cylinder 3*a* and the arm cylinder 3*b* is an actuator requiring a larger maximum flow rate than the maximum flow rates required by the other actuators.

A pilot pressure reducing valve 70*a* (first valve operation limiting device) for reducing an arm crowding operation pressure b1 and introducing the reduced arm crowding operation pressure b1, and a pilot pressure reducing valve 70*b* (first valve operation limiting device) for reducing an arm dumping operation pressure b2 and introducing the reduced arm dumping operation pressure b2 are provided in the pilot port of the flow control valve 106*b*. A boom raising operation pressure a1 is introduced to a set pressure change input section of the pilot pressure reducing valve 70*a*, while a boom lowering operation pressure a2 is introduced to a set pressure change input section of the pilot pressure reducing valve 70*b*.

A pilot pressure reducing valve 70*c* (second valve operation limiting device) for reducing the boom raising operation pressure a1 and introducing the reduced boom raising operation pressure a1 is provided in a boom raising side pilot port of the flow control valve 206*a*. The arm crowding operation pressure b1 is introduced to a set pressure change input section of the pilot pressure reducing valve 70*c*.

Figure 4:
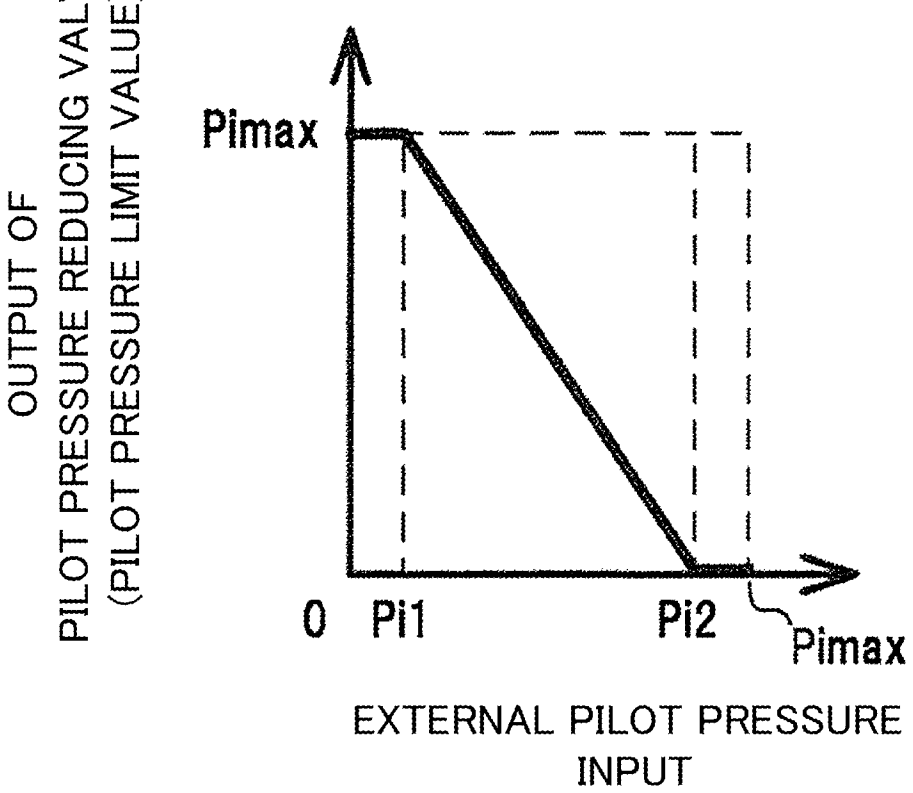
FIG. 4 is a chart showing a pressure reducing characteristic of a pilot pressure reducing valve.

FIG. 4 is a chart showing a pressure reducing characteristic of each of the pilot pressure reducing valves 70*a*, 70*b*, and 70*c*. Each of the pressure reducing characteristics of the pilot pressure reducing valves 70*a*, 70*b*, and 70*c* is set such that the operation pressure (e.g., Pimax) of each input port of the pilot pressure reducing valves 70*a*, 70*b*, and 70*c* is output without change while each of the operation pressures b1, b2, and a1 at the set pressure change input sections is a tank pressure (0-Pi1). The output pressure lowers as each of the operation pressures b1, b2, and a1 increases in excess of the tank pressure, and further lowers to reach the tank pressure when the operation pressure b1, b2, and a1 become Pi2 which is slightly smaller than Pimax.

In this manner, the actuators 3*a*, 3*b*, and 3*d* provide a plurality of first actuators that include the boom cylinder 3*a* and the arm cylinder 3*b* in the plurality of actuators 3*a* to 3*h* but do not include the left and right traveling motors 3*f* and 3*g*. The actuators 3*f* and 3*g* provide a plurality of second actuators that include the left and right traveling motors 3*f* and 3*g* in the plurality of actuators 3*a* to 3*h*. The actuators 3*c*, 3*e*, and 3*h* provide a plurality of third actuators that include the swing motor 3*c* in the plurality of actuators 3*a* to 3*h* but do not include the left and right traveling motors 3*f* and 3*g*.

The flow control valves 106*a*, 106*b*, and 106*d* and the flow control valves 206*a* and 206*b* provide a plurality of first flow control valves of a closed center type connected to the plurality of the first actuators 3*a*, 3*b*, and 3*d* and form a closed circuit. The directional control valves 116 and 216 provide a plurality of second flow control valves of an open center type connected to the plurality of second actuators 3*f* and 3*g* and form an open center circuit. The flow control valves 306*c*, 306*e*, and 306*h* provide a plurality of third flow control valves of a closed center type connected to the plurality of third actuators 3*c*, 3*e*, and 3*h* and form a closed circuit.

The main pumps 101 and 201 provide first and second pumps that supply hydraulic fluids to the plurality of first and second flow control valves 106*a*, 106*b*, 106*d*, 206*a*, 206*b*, 116, and 216. The main pump 301 provides a third pump that supplies hydraulic fluids to the plurality of first and third flow control valves 106*a*, 106*b*, and 106*d*, and 306*c*, 306*e*, and 306*h*.

The signal selector valves 117 and 217, the restrictor 150, and the pilot pressure signal hydraulic line 150*a* provide a traveling operation detection device which detects traveling operation for driving the left and right traveling motors 3*f* and 3*g*.

The selector valve 140 provides a selector valve device that lies at a first position for introducing hydraulic fluids delivered from the first and second pumps 101 and 201 to the plurality of first flow control valves 106*a*, 106*b*, 106*d*, 206*a*, and 206*b* when the traveling operation detection device 117, 217 and 150*a* does not detect traveling operation, and switches to a second position for introducing hydraulic fluids delivered from the first and second pumps 101 and 201 to the plurality of second flow control valves 116 and 216, and introducing hydraulic fluid delivered from the third pump 301 to the plurality of first flow control valves 106*a*, 106*b*, 106*d*, 206*a*, and 206*b* when the traveling operation detection device 117, 217 and 150*a* detects traveling operation.

The regulators 112, 212, and 312 provide first, second, and third delivery rate control devices that individually change delivery rates of the first, second, and third pumps 101, 201, and 301, respectively.

The first and second delivery rate control devices 112 and 212 are configured to perform load sensing control such that delivery pressures of the first and second pumps 101 and 201 become higher than the maximum load pressure of the respective actuators driven by delivery fluids of the first and second pumps 101 and 201 in the plurality of first actuators 3*a*, 3*b* and 3*d* by a given set value when the traveling operation detection device 117, 217, 150*a* does not detect the travelling operation and the selector valve device 140 is located at the first position, and stop the load sensing control of the first and second pumps 101 and 201 and drive the plurality of second actuators 3*f* and 3*g* when the traveling operation detection device 117, 217 and 150*a* detects the traveling operation and the selector valve device 140 switches to the second position.

The third delivery rate control device 312 is configured to perform load sensing control such that the delivery pressure of the third pump 301 becomes higher than the maximum load pressure of the plurality of third actuators 3*c*, 3*e*, and 3*h* by a given set value when the traveling operation detection device 117, 217 and 150*a* does not detect the traveling operation and the selector valve 140 is located at the first position, and perform load sensing control such that the delivery pressure of the third pump 301 becomes higher than the maximum load pressure of the plurality of first and third actuators 3*a*, 3*b*, and 3*d* and 3*c*, 3*e*, and 3*h* by a given set value when the traveling operation detection device 117, 217 and 150*a* detects the traveling operation and the selector valve device 140 switches to the second position.

The plurality of first flow control valves 106*a*, 106*b*, 106*d*, 206*a*, and 206*b* include a first valve section 104*a* that includes the flow control valve 106*a* for the boom, and a second valve section 104*b* that includes the flow control valve 206*b* for the arm. The first and second valve sections 104*a* and 104*b* are configured such that the boom cylinder 3*a* and the arm cylinder 3*b* are independently driven by delivery fluids of the first and second pumps 101 and 201 when at least either one of a boom operation for driving the boom cylinder 3*a* and an arm operation for driving the arm cylinder 3*b* is a full-operation in a combined operation for simultaneously driving the boom cylinder 3*a* and the arm cylinder 3*b*.

The pilot pressure reducing valves 70*a* and 70*b* provide a first valve operation limiting device that holds the flow control valve 106*b* for assist driving of the arm at a neutral position when the boom operation is at least a full-operation, and the pilot pressure reducing valve 70*c* provides a second valve operation limiting device that holds the flow control valve 206*a* for assist driving of the boom at a neutral position when the arm operation is at least a full-operation.

The first valve section 104*a* includes the flow control valve 106*a* for main driving of the boom as the flow control valve for the boom, and the arm flow control valve 106*b* for assist driving of the arm, and includes the first valve operation limiting devices 70*a* and 70*b*. The second valve section 104*b* includes the flow control valve 206*b* for main driving of the arm as the flow control valve for the arm, and the boom flow control valve 206*a* for assist driving of the boom, and includes the second valve operation limiting device 70*c*.

~Hydraulic Excavator~

Figure 2:
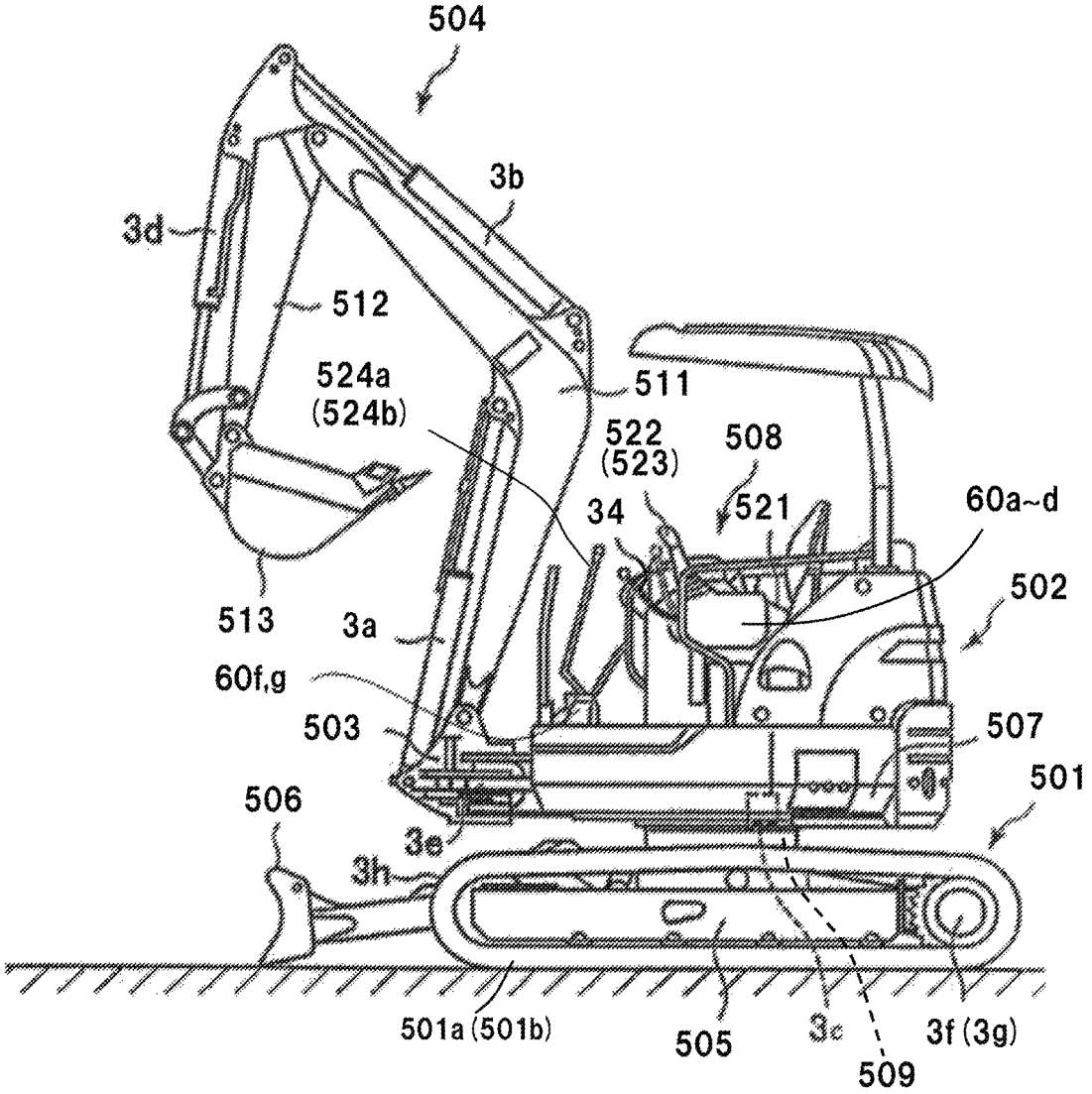
FIG. 2 is a view showing an external appearance of a hydraulic excavator as a work machine on which the hydraulic drive system of the present embodiment is mounted.

FIG. 2 is a view showing an external appearance of a hydraulic excavator as a work machine on which the hydraulic drive system described above is mounted.

The hydraulic excavator well known as a work machine in FIG. 2 is constituted by a lower track structure 501, an upper swing structure 502, and a front implement 504 of a swing type. The front implement 504 is constituted by a boom 511, an arm 512, and a bucket 513. The upper swing structure 502 is allowed to swing with respect to the lower track structure 501 in accordance with driving of a swing device 509 by the swing motor 3*c*. A swing post 503 is attached to a front part of the upper swing structure 502. The front implement 504 is attached to the swing post 503 in such a manner as to be movable upward and downward. The swing post 503 is rotatable in the horizontal direction with respect to the upper swing structure 502 by expansion and contraction of the boom-swing cylinder 3*e*, while the boom 511, the arm 512, and the bucket 513 of the front implement 504 are rotatable in the up-down direction by expansion and contraction of the boom cylinder 3*a*, the arm cylinder 3*b*, and the bucket cylinder 3*d*. A blade 506 moving upward and downward by expansion and contraction of the blade cylinder 3*h* is attached to a center frame of the lower track structure 501. The lower track structure 501 travels by driving left and right crawlers 501*a* and 501*b* in accordance with rotations of the traveling motors 3*f* and 3*g*.

A cab 508 of a canopy type is provided on the upper swing structure 502. A driver's seat 521, left and right operation devices 522 and 523 for the front/swing operations (FIG. 2 shows left only), left and right traveling operation devices 524*a* and 524*b* (FIG. 2 shows left only), a boom-swing operation device 525 (FIG. 1), a blade operation device 526 (FIG. 1), a gate lock lever 34, and others are included in the cab 508.

An operation lever of each of the operation devices 522 and 523 is operable in any direction on the basis of a cross direction from a neutral position. When the operation lever of the left operation device 522 is operated in the left-right direction, a swing operation pilot valve 60*c* operates by a function of the operation device 522 as a swing operation device 522*b* (FIG. 1). When the operation lever of the operation device 522 is operated in the front-rear direction, an arm pilot valve 60*b* operates by a function of the operation device 522 as an arm operation device 522*a* (FIG. 1). When the operation lever of the right operation device 523 is operated in the front-rear direction, a boom pilot valve 60*a* operates by a function of the operation device 523 as a boom operation device 523*a* (FIG. 1). When the operation lever of the operation device 523 is operated in the left-right direction, a bucket pilot valve 60*d* operates by a function of the operation device 523 as a bucket operation device 523*b* (FIG. 1).

When the operation lever of a left traveling operation device 524*a* is operated, a left traveling pilot valve 60*f* (FIG. 1) operates. When the operation lever of a right traveling operation device 524*b* is operated, a right traveling pilot valve 60*g* (FIG. 1) operates. When a boom-swing operation device 525 (FIG. 1) is operated, a boom-swing pilot valve 60*e* operates. When a blade operation device 526 (FIG. 1) is operated, a blade pilot valve 60*h* operates.

~Operation~

An operation of the present embodiment will be described with reference to FIGS. 1, 1A, 1B, 1C, 2, 3A, 3B, and 4.

Hydraulic fluid delivered from the pilot pump 30 of the fixed displacement type driven by the prime mover is supplied to a hydraulic fluid supply path 31*a*.

The prime mover revolution speed detection valve 13 is connected to the hydraulic fluid supply path 31*a*. The prime mover revolution speed detection valve 13 outputs a delivery rate of the pilot pump 30 of the fixed displacement type as the absolute pressure Pgr by using the variable restrictor 13*a* and the differential pressure reducing valve 13*b*.

The pilot relief valve 32 is connected to the downstream of the prime mover revolution speed detection valve 13 to generate the fixed pressure Pi0 in a hydraulic fluid supply path 31*b*.

(a) Operation Levers of all Operation Devices: Neutral

The operation levers of all the operation devices are in neutral, wherefore each of the flow control valves 106*a*, 106*b*, 106*d*, 206*a*, 206*b*, 306*c*, 306*e*, and 306*h*, and the directional control valves 116 and 216 is held at the neutral position by springs provided at both ends of the corresponding valve.

The directional control valves 116 and 216 are in neutral, and the signal selector valves 117 and 217 are held at communication positions. In this case, hydraulic fluid introduced to the signal hydraulic line 150*a* from the hydraulic fluid supply path 31*b* via the restrictor 150 is discharged to the tank via the signal selector valves 117 and 217. As a result, the pressure at the signal hydraulic line 150*a* becomes a tank pressure.

The pressure at the signal hydraulic line 150*a* is introduced to each of the selector valve 140, the LS valve output pressure selector valves 112*a* and 212*a*, the selector valves 120, 220, and 320, and the maximum capacity selector pistons 112*g* and 212*g*. The pressure at this time is a tank pressure, wherefore the respective selector valves are held at positions shown in the figure by the corresponding springs. The maximum capacity selector pistons 112*g* and 212*g* are located at upward positions by the springs. The maximum capacities of the main pumps 101 and 201 have been switched to Mf (>Mt).

The selector valve 140 is located at the first position (position after switching toward left in the figure by the spring). Accordingly, the hydraulic fluid supply path 105 of the main pump 101 is introduced to the hydraulic fluid supply path 105*a*, while the hydraulic fluid supply path 205 of the main pump 201 is introduced to the hydraulic fluid supply path 205*a*.

All the flow control valves 106*a*, 106*b*, and 106*d* connected to the hydraulic fluid supply path 105*a* are located at neutral positions. Accordingly, the maximum load pressure Plmax1 is a tank pressure.

The selector valve 120 located at the position switched downward in the figure by the spring, wherefore Plmax1 described above is introduced to the differential pressure reducing valve 111 and the unloading valve 115.

Accordingly, the pressure P1 of the hydraulic fluid supply path 105*a* is held at a pressure slightly higher than the output pressure Pgr of the prime mover revolution speed detection valve 13 by the spring provided on the unloading valve 115.

The differential pressure reducing valve 111 outputs a differential pressure between the pressure P1 of the hydraulic fluid supply path 105*a* and Plmax1 as the LS differential pressure Pls1. When all the operation levers are in neutral, Plmax1 is equivalent to the tank pressure as described above. Accordingly, assuming the tank pressure is 0, Pls1=P1−Plmax1=P1>Pgr holds.

The LS differential pressure Pls1 is introduced to the LS valve 112*b* within the regulator 112 of the main pump 101. The LS valve 112*b* compares Pls1 and Pgr, and discharges hydraulic fluid of the flow rate control piston 112*c* to the tank in case of Pls1<Pgr, or introduces the fixed pilot pressure Pi0 generated by the pilot relief valve 32 to the flow rate control piston 112*c* via the LS valve output pressure selector valve 112*a* in case of Pls1>Pgr.

As described above, Pls1 is higher than Pgr when all the operation levers are in neutral. In this case, the LS valve 112*b* is switched toward the left in the figure, whereby the pilot pressure Pi0 generated by the pilot relief valve 32 and maintained at a fixed value is output from the LS valve 112*b*. The LS valve output pressure selector valve 112*a* is located at the position switched toward the left in the figure by the spring. Accordingly, output of the LS valve 112*b* is introduced to the flow rate control piston 112*c*.

Hydraulic fluid is introduced to the flow rate control piston 112*c*, wherefore the capacity of the main pump 101 of the variable displacement type is maintained at the minimum.

All the flow control valves 206*a* and 206*b* connected to the hydraulic fluid supply path 205*a* are located at neutral positions. Accordingly, the maximum load pressure Plmax2 is a tank pressure.

The selector valve 220 located at the position switched downward in the figure by the spring, wherefore Plmax2 described above is introduced to the differential pressure reducing valve 211 and the unloading valve 215.

Accordingly, the pressure P2 of the hydraulic fluid supply path 205*a* is held at a pressure slightly higher than the output pressure Pgr of the prime mover revolution speed detection valve 13 by the spring provided on the unloading valve 215.

The differential pressure reducing valve 211 outputs a differential pressure between the pressure P2 of the hydraulic fluid supply path 205*a* and Plmax2 as the LS differential pressure Pls2. When all the operation levers are in neutral, Plmax2 is equivalent to the tank pressure as described above. Accordingly, Pls2=P2−Plmax2=P2>Pgr holds.

The LS differential pressure Pls2 is introduced to the LS valve 212*b* included in the regulator 212 of the main pump 201. The LS valve 212*b* compares Pls2 and Pgr, and discharges hydraulic fluid of the load sensing tilt control piston 212*c* to the tank in case of Pls2<Pgr, or introduces the fixed pilot pressure Pi0 generated by the pilot relief valve 32 to the load sensing tilt control piston 212*c* via the LS valve output pressure selector valve 212*a* in case of Pls2>Pgr.

As described above, Pls2 is higher than Pgr when all the operation levers are in neutral. In this case, the LS valve 212*b* is switched toward the right in the figure, whereby the pilot pressure Pi0 generated by the pilot relief valve 32 and maintained at a fixed value is output from the LS valve 212*b*. The LS valve output pressure selector valve 212*a* is located at the position switched toward the right in the figure by the spring, whereby output of the LS valve 212*b* is introduced to the load sensing tilt control piston 212*c*.

Hydraulic fluid is introduced to the load sensing tilt control piston 212*c*. Accordingly, the capacity of the main pump 201 of the variable displacement type is maintained at the minimum.

All the flow control valves 306*c*, 306*e*, and 306*h* connected to the hydraulic fluid supply path 305 are located at neutral positions. Accordingly, the maximum load pressure Plmax3 is a tank pressure.

The selector valve 320 is located at the position switched downward in the figure by the spring, and therefore introduces Plmax3 described above to the differential pressure reducing valve 311 and the unloading valve 315.

Accordingly, the pressure P3 of the hydraulic fluid supply path 305 is held at a pressure slightly higher than the output pressure Pgr of the prime mover revolution speed detection valve 13 by the spring provided on the unloading valve 315.

The differential pressure reducing valve 311 outputs a differential pressure between the pressure P3 of the hydraulic fluid supply path 305 and Plmax3 as the LS differential pressure Pls3. When all the operation levers are in neutral, Plmax3 is equivalent to the tank pressure as described above. Accordingly, Pls3=P3−Plmax3=P3>Pgr holds.

The LS differential pressure Pls3 is introduced to the LS valve 312*b* included in the regulator 312 of the main pump 301. The LS valve 312*b* compares Pls3 and Pgr, and discharges hydraulic fluid of the load sensing tilt control piston 312*c* to the tank in case of Pls3<Pgr, or introduces the fixed pilot pressure Pi0 generated by the pilot relief valve 32 to the load sensing tilt control piston 312*c* in case of Pls3>Pgr.

As described above, Pls3 is higher than Pgr when all the operation levers are in neutral. In this case, the LS valve 312*b* is switched toward the right in the figure, whereby the pilot pressure Pi0 generated by the pilot relief valve 32 and maintained at a fixed value is introduced to the load sensing tilt control piston 312*c*.

Hydraulic fluid is introduced to the load sensing tilt control piston 312*c*. Accordingly, the capacity of the main pump 301 of the variable displacement type is maintained at the minimum.

(b) Boom Raising

When only the boom raising operation is performed by the operation lever of the boom operation device 523*a*, the operation levers of the traveling operation devices 524*a* and 524*b* are in neutral. In this case, the signal selector valves 117 and 217 are held at the communication positions, wherefore the pressure of the signal hydraulic line 150*a* becomes the tank pressure similarly to the case (a) all the operation levers in neutral. Accordingly, the selector valve 140, the LS valve output pressure selector valves 112*a* and 212*a*, and the selector valves 120, 220, and 320 are held at the positions switched by the corresponding springs. The maximum capacity selector pistons 112*g* and 212*g* are located at upward positions switched by the springs. The maximum capacities of the main pumps 101 and 201 have been switched to Mf (>Mt).

The selector valve 140 is located at the position switched toward the left in the figure by the spring. Accordingly, the hydraulic fluid supply path 105 of the main pump 101 is introduced to the hydraulic fluid supply path 105*a*, while the hydraulic fluid supply path 205 of the main pump 201 is introduced to the hydraulic fluid supply path 205*a*.

The boom raising pressure a1 output from the boom cylinder operation pilot valve 60*a* is introduced to the left end of the boom flow control valve 106*a* in the figure, whereby the flow control valve 106*a* is switched toward the right in the figure.

The boom raising operation pressure a1 is also introduced to a right input port of the pilot pressure reducing valve 70*c* in the figure. As shown in FIG. 4, the pilot pressure reducing valve 70*c* has such a characteristic that the output pressure decreases from a pressure equivalent to the input pressure to the tank pressure when the pressure of the set pressure change input section increases from the tank pressure.

The arm crowding operation pressure b1 is introduced to the set pressure change input section of the pilot pressure reducing valve 70*c*. However, when only the boom raising is operated, the tank pressure is introduced as the arm crowding operation pressure b1. Accordingly, the boom raising pilot pressure a1 input to the pilot pressure reducing valve 70*c* is introduced to the left end of the flow control valve 206*a* in the figure without regulation, and the flow control valve 206*a* is switched toward the right in the figure.

In response to switching of the flow control valve 106*a*, hydraulic fluid is supplied to the bottom side of the boom cylinder 3*a* via the flow control valve 106*a*. Simultaneously, a load pressure on the bottom side of the boom cylinder 3*a* is introduced to the selector valve 120 via the load pressure detection port formed in the flow control valve 106*a* and the shuttle valves 109*a* and 109*b*. At this time, the selector valve 120 has been switched downward in the figure as described above. Accordingly, the load pressure on the bottom side of the boom cylinder 3*a* is introduced to the unloading valve 115 and the differential pressure reducing valve 111 as the maximum load pressure Plmax1.

A set pressure of the unloading valve 115 increases to the sum of the load pressure of the boom cylinder 3*a* and the spring force in accordance with Plmax1 introduced to the unloading valve 115, and interrupts the hydraulic line for discharging the hydraulic fluid of the hydraulic fluid supply path 105*a* to the tank.

The differential pressure reducing valve 111 outputs P1−Plmax1 as the LS differential pressure Pls1 in accordance with Plmax1 introduced to the differential pressure reducing valve 111. At the moment of a start of the boom 511 in the raising direction, P1 has been maintained at a low pressure determined beforehand by the spring of the unloading valve, wherefore Pls1 becomes substantially equivalent to the tank pressure.

The LS differential pressure Pls1 is introduced to the LS valve 112*b* included in the flow rate control regulator 112 of the main pump 101 of the variable displacement type.

As described above, Pls1=tank pressure<Pgr holds at the start of boom raising. Accordingly, the LS valve 112*b* is switched toward the right in the figure.

The LS valve output pressure selector valve 112*a* is located at the neutral position (position switched toward left in the figure by the spring). In this condition, the hydraulic fluid of the flow rate control piston 112*c* is discharged to the tank via the LS valve output pressure selector valve 112*a* and the LS valve 112*b*.

Accordingly, the flow rate of the main pump 101 of the variable displacement type increases. This flow rate increase continues until Pls1 becomes equivalent to Pgr.

Similarly, in response to switching of the flow control valve 206*a*, hydraulic fluid is supplied to the bottom side of the boom cylinder 3*a* via the flow control valve 206*a*. Simultaneously, a load pressure on the bottom side of the boom cylinder 3*a* is introduced to the selector valve 220 via the load pressure detection port formed in the flow control valve 206*a* and the shuttle valve 209*a*. At this time, the selector valve 220 has been switched downward in the figure as described above. Accordingly, the load pressure on the bottom side of the boom cylinder 3*a* is introduced to the unloading valve 215 and the differential pressure reducing valve 211 as the maximum load pressure Plmax2.

A set pressure of the unloading valve 215 increases to the sum of the load pressure of the boom cylinder 3*a* and the spring force in accordance with Plmax2 introduced to the unloading valve 215, and interrupts the hydraulic line for discharging the hydraulic fluid of the hydraulic fluid supply path 205*a* to the tank.

The differential pressure reducing valve 211 outputs P2−Plmax2 as the LS differential pressure Pls2 in accordance with on Plmax2 introduced to the differential pressure reducing valve 211. At the moment of a start of the boom 511 in the raising direction, P2 has been maintained at a low pressure determined beforehand by the spring of the unloading valve, wherefore Pls2 becomes substantially equivalent to the tank pressure.

The LS differential pressure Pls2 is introduced to the LS valve 212*b* included in the flow rate control regulator 212 of the main pump 201 of the variable displacement type.

As described above, Pls2=tank pressure<Pgr holds at the start of boom raising. Accordingly, the LS valve 212*b* is switched toward the left in the figure.

The LS valve output pressure selector valve 212*a* is located at the neutral position (position switched toward the left in the figure by the spring). In this condition, the hydraulic fluid of the tilt control piston 212*c* is discharged to the tank via the LS valve output pressure selector valve 212*a* and the LS valve 212*b*.

Accordingly, the flow rate of the main pump 201 of the variable displacement type increases. This flow rate increase continues until Pls2 becomes equivalent to Pgr.

Meanwhile, in case of operation of only boom raising, the flow control valves 306*c*, 306*e*, and 306*h* connected to the hydraulic fluid supply path 305 of the main pump 301 are not switched. Accordingly, the capacity of the main pump 301 is maintained at the minimum similarly to the case of (a) all the levers in neutral.

As described above, in case of the boom raising operation, load sensing control is performed in each of the main pumps 101 and 201. Hydraulic fluid delivered from the main pumps 101 and 201 are combined and supplied to the boom cylinder 3*a*. At this time, the maximum capacity of each of the main pumps 101 and 201 has been switched to Mf (>Mt). Accordingly, speedy boom raising operation is achievable.

(c) Leveling

In the leveling operation, in general, the arm crowding operation and the boom raising operation are simultaneously performed by using the operation lever of the arm operation device 522*a* and the operation lever of the boom operation device 523*a*.

Operations executed by the actuators are extension of the arm cylinder 3*b* and extension of the boom cylinder 3*a*. Operations performed at this time will be hereinafter described.

The traveling operation lever is in neutral. Accordingly, the signal selector valves 117 and 217 are held at the communication positions. Similarly to the case of (a) all levers in neutral, the pressure of the signal hydraulic line 150*a* becomes the tank pressure, while the selector valve 140, the LS valve output pressure selector valves 112*a* and 212*a*, and the selector valves 120, 220, and 320 are each held at positions switched by the springs. The maximum capacity selector pistons 112*g* and 212*g* are located at upward positions switched by the springs. The maximum capacities of the main pumps 101 and 201 have been switched to Mf (>Mt).

The selector valve 140 is located at the position switched toward left in the figure by the spring. Accordingly, the hydraulic fluid supply path 105 of the main pump 101 is introduced to the hydraulic fluid supply path 105*a*, while the hydraulic fluid supply path 205 of the main pump 201 is introduced to the hydraulic fluid supply path 205*a*.

The boom raising pressure a1 output from the boom cylinder operation pilot valve 60*a* is introduced to the left end of the boom flow control valve 106*a* in the figure, while the flow control valve 106*a* is switched toward the right in the figure.

The boom raising operation pressure a1 is also introduced to a right end input port of the pilot pressure reducing valve 70*c* in the figure. As shown in FIG. 4, the pilot pressure reducing valve 70*c* has such a characteristic that the output pressure decreases from a pressure equivalent to the input pressure to the tank pressure when the pressure of the set pressure change input section increases from the tank pressure.

The arm crowding operation pressure b1 is introduced to the set pressure change input section of the pilot pressure reducing valve 70*c*. In the leveling operation, in general, the boom raising operation and the arm crowding operation are simultaneously performed. If the arm crowding operation is a full operation, the boom raising operation pressure a1 is limited to the tank pressure based on the characteristic shown in FIG. 4.

The flow control valve 206*a* is a flow control valve for assist driving of the boom cylinder 3*a*, wherefore the meter-in opening of the flow control valve 206*a* has the characteristic shown in FIG. 3. Accordingly, when the operation pressure is limited to the tank pressure as described above, the meter-in opening of the flow control valve 206*a* becomes 0.

Meanwhile, the arm crowding operation pressure b1 output from the arm cylinder operation pilot valve 60*b* is introduced to the right end of the arm flow control valve 206*b* in the figure, whereby the flow control valve 206*b* is switched toward the left in the figure.

The arm crowding operation pressure b1 is also introduced to a left end input port of the pilot pressure reducing valve 70*a* in the figure. The boom raising operation pressure a1 is introduced to the set pressure change input section of the pilot pressure reducing valve 70*a*. Similarly to the above case, the pilot pressure reducing valve 70*a* has the characteristic shown in FIG. 4. Accordingly, if the boom raising operation is a full operation, the arm crowding operation pressure b1 is limited to the tank pressure based on the characteristic in FIG. 4.

The flow control valve 106*b* is a flow control valve for assist driving of the arm cylinder, wherefore the meter-in opening of the flow control valve 106*b* has a characteristic shown in FIG. 3. Accordingly, when the operation pressure is limited to the tank pressure as described above, the meter-in opening of the flow control valve 106*b* becomes 0.

Accordingly, as described above, switched in performing the leveling operation are only the flow control valve 106*a* connected to the hydraulic fluid supply path 105*a* of the main pump 101 as the boom cylinder flow control valve, and only the flow control valve 206*b* connected to the hydraulic fluid supply path 205*a* of the main pump 201 as the arm cylinder flow control valve.

In response to switching of the flow control valve 106*a*, hydraulic fluid is supplied to the bottom side of the boom cylinder 3*a* via the flow control valve 106*a*. Simultaneously, the load pressure on the bottom side of the boom cylinder 3*a* is introduced to the selector valve 120 via the load pressure detection port formed in the flow control valve 106*a* and the shuttle valves 109*a* and 109*b*. The selector valve 120 has been switched downward in the figure as described above. Accordingly, the load pressure on the bottom side of the boom cylinder 3*a* is introduced to the unloading valve 115 and the differential pressure reducing valve 111 as Plmax1.

The set pressure of the unloading valve 115 increases to the sum of the load pressure of the boom cylinder 3*a* and the spring force in accordance with Plmax1 introduced to the unloading valve 115, and interrupts the hydraulic line for discharging the hydraulic fluid of the hydraulic fluid supply path 105*a* to the tank.

The differential pressure reducing valve 111 outputs P1−Plmax1 as the LS differential pressure Pls1 based on Plmax1 introduced to the differential pressure reducing valve 111. At the moment of a start of the boom in the raising direction, P1 has been maintained at a low pressure determined beforehand by the spring of the unloading valve, wherefore Pls1 becomes substantially equivalent to the tank pressure.

The LS differential pressure Pls1 is introduced to the LS valve 112*b* included in the flow rate control regulator 112 of the main pump 101 of the variable displacement type.

As described above, Pls1=tank pressure<Pgr holds at the start of boom raising. Accordingly, the LS valve 112*b* is switched toward the right in the figure.

The LS valve output pressure selector valve 112*a* is located at the neutral position (position switched toward left in the figure by the spring). In this condition, the hydraulic fluid of the flow rate control piston 112*c* is discharged to the tank via the LS valve output pressure selector valve 112*a* and the LS valve 112*b*.

Accordingly, the flow rate of the main pump 101 of the variable displacement type increases. This flow rate increase continues until Pls1 becomes equivalent to Pgr.

Similarly, in response to switching of the flow control valve 206*b*, hydraulic fluid is supplied to the bottom side of the arm cylinder 3*b* via the flow control valve 206*b*. Simultaneously, the load pressure on the bottom side of the arm cylinder 3*b* is introduced to the selector valve 220 via the load pressure detection port formed in the flow control valve 206*b* and the shuttle valve 209*a*. At this time, the selector valve 220 has been switched downward in the figure as described above. Accordingly, the load pressure on the bottom side of the arm cylinder 3*b* is introduced to the unloading valve 215 and the differential pressure reducing valve 211 as the maximum load pressure Plmax2.

The set pressure of the unloading valve 215 increases to the sum of the load pressure of the arm cylinder 3*b* and the spring force in accordance with Plmax2 introduced to the unloading valve 215, and interrupts the hydraulic line for discharging the hydraulic fluid of the hydraulic fluid supply path 205*a* to the tank.

The differential pressure reducing valve 211 outputs P2−Plmax2 as the LS differential pressure Pls2 based on Plmax2 introduced to the differential pressure reducing valve 211. At the moment of a start of the arm in the crowding direction, P2 has been maintained at a low pressure determined beforehand by the spring of the unloading valve, wherefore Pls2 becomes substantially equivalent to the tank pressure.

As described above, Pls2=tank pressure<Pgr holds at the start of arm crowding. Accordingly, the LS valve 212*b* is switched toward the left in the figure.

The LS valve output pressure selector valve 212*a* is located at the neutral position (position switched toward the right in the figure by the spring). In this condition, the hydraulic fluid of the tilt control piston 212*c* is discharged to the tank via the LS valve output pressure selector valve 212*a* and the LS valve 212*b*.

Accordingly, the flow rate of the main pump 201 of the variable displacement type increases. This flow rate increase continues until Pls2 becomes equivalent to Pgr.

Meanwhile, in performing the leveling operation, the flow control valves 306*c*, 306*e*, and 306*h* connected to the hydraulic fluid supply path 305 of the main pump 301 are not switched. Accordingly, the capacity of the main pump 301 is maintained at the minimum similarly to the case of (a) all levers in neutral.

In the leveling operation performed in the manner described above, load sensing control is performed in each of the main pumps 101 and 201. The boom cylinder 3*a* and the arm cylinder 3*b* are driven by the different main pumps 101 and 201. In this case, highly efficient work is achievable by reducing a bleed-off loss at the unloading valve, and preventing a meter-in loss (restrictor loss) at the pressure compensating valve of the low-load side actuator. This is applicable to other operations performed by the front implement 504 and not including traveling, such as excavating work and leveling work.

When the arm 512 of the front implement 504 is an extremely long arm, a larger number of boom raising operations corresponding to arm drawing operation may be required to perform leveling operation. According to Patent Document 2, the meter-in opening of the boom assist flow control valve opens in this situation. As a result, a meter-in loss is produced at the pressure compensating valve of the arm corresponding to the low load pressure actuator in the leveling operation. In this case, highly efficient work may be difficult to achieve.

According to the present embodiment, as described above, the boom cylinder 3*a* and the arm cylinder 3*b* are securely driven by the different main pumps 101 and 201 in performing the leveling operation. Accordingly, highly efficient work is achievable without producing a restrictor loss (meter-in loss) at the arm side pressure compensating valve 207*b*.

(d) Combined Operations of Boom Raising and Swing.

In the combined operation combining boom raising and swing, the boom raising operation by the operation lever of the boom operation device 523*a*, and the swing operation by the operation lever of the swing operation device 522*b* are simultaneously performed.

Operations for extending the boom cylinder 3*a* and rotating the swing motor 3*c* are performed. Operations executed at this time will be hereinafter described.

The traveling operation lever is in neutral. Accordingly, the signal selector valves 117 and 217 are held at the communication positions. Similarly to the case of (a) all levers in neutral, the pressure of the signal hydraulic line 150*a* becomes the tank pressure, while the selector valve 140, the LS valve output pressure selector valves 112*a* and 212*a*, and the selector valves 120, 220, and 320 are each held at positions switched by the springs. The maximum capacity selector pistons 112*g* and 212*g* are located at upward positions switched by the springs. The maximum capacities of the main pumps 101 and 201 have been switched to Mf (>Mt).

The selector valve 140 is located at the position switched toward the left in the figure by the spring. Accordingly, the hydraulic fluid supply path 105 of the main pump 101 is introduced to the hydraulic fluid supply path 105*a*, while the hydraulic fluid supply path 205 of the main pump 201 is introduced to the hydraulic fluid supply path 205*a*.

If the swing operation pressure c1 is output from the swing operation pilot valve 60*c*, the swing operation pressure c1 is introduced to the left end of the flow control valve 306*c* for controlling the swing motor 3*c* in the figure. Accordingly, the flow control valve 306*c* is switched toward the right in the figure.

In response to switching of the flow control valve 306*c*, hydraulic fluid is supplied to the swing motor 3*c* via the flow control valve 306*c*. Simultaneously, a load pressure of the swing motor 3*c* is introduced to the selector valve 320 via the load pressure detection port formed in the flow control valve 306*c* and the shuttle valves 309*c* and 309*e*. At this time, the selector valve 320 has been switched downward in the figure as described above. Accordingly, the load pressure of the swing motor is introduced to the unloading valve 315 and the differential pressure reducing valve 311 as the maximum load pressure Plmax3.

The set pressure of the unloading valve 315 increases to the sum of the load pressure of the swing motor 3*c* and the spring force by Plmax3 introduced to the unloading valve 315, and interrupts the hydraulic line for discharging the hydraulic fluid of the hydraulic fluid supply path 305 to the tank.

The differential pressure reducing valve 311 outputs P3−Plmax3 as the LS differential pressure Pls3 based on Plmax3 introduced to the differential pressure reducing valve 311. At the moment of a start of swing, P3 has been maintained at a low pressure determined beforehand by the spring of the unloading valve, wherefore Pls3 becomes substantially equivalent to the tank pressure.

The LS differential pressure Pls3 is introduced to the LS valve 312*b* included in the flow rate control regulator 312 of the main pump 301 of the variable displacement type.

As described above, Pls3=tank pressure<Pgr holds at the start of swing. Accordingly, the LS valve 312*b* is switched toward the left in the figure. As a result, hydraulic fluid of the tilt control piston 312*c* is discharged to the tank via the LS valve 312*b*.

Accordingly, the flow rate of the main pump 301 of the variable displacement type increases. This flow rate increase continues until Pls3 becomes equivalent to Pgr.

The delivery pressure P3 of the main pump 301 and the pressure of the tilt control piston 312*c* are introduced to the torque estimation section 310, and output as a torque feedback pressure.

An operation of the torque estimation section 310 is detailed in Patent Document 2 (JP-2015-148236-A), and therefore is not repeatedly described herein.

Meanwhile, the boom raising pressure a1 output from the boom cylinder operation pilot valve 60*a* is introduced to the left end of the boom flow control valve 106*a* in the figure, whereby the flow control valve 106*a* is switched toward the right in the figure.

The boom raising operation pressure a1 is also introduced to the right input port of the pilot pressure reducing valve 70*c* in the figure. Similarly to the case that only (b) boom raising operation is performed, the boom raising pilot pressure a1 input to the pilot pressure reducing valve 70*c* is introduced to the left end of the flow control valve 206*a* in the figure without regulation. Accordingly, the flow control valve 206*a* is switched toward the right in the figure.

In response to switching of the flow control valve 106*a*, hydraulic fluid is supplied to the bottom side of the boom cylinder 3*a* via the flow control valve 106*a*. Simultaneously, a load pressure on the bottom side of the boom cylinder 3*a* is introduced to the selector valve 120 via the load pressure detection port formed in the flow control valve 106*a* and the shuttle valves 109*a* and 109*b*. At this time, the selector valve 120 is switched downward in the figure as described above. Accordingly, the load pressure on the bottom side of the boom cylinder 3*a* is introduced to the unloading valve 115 and the differential pressure reducing valve 111 as the maximum load pressure Plmax1.

The set pressure of the unloading valve 115 increases to the sum of the load pressure of the boom cylinder 3*a* and the spring force in accordance with Plmax1 introduced to the unloading valve 115, and interrupts the hydraulic line for discharging the hydraulic fluid of the hydraulic fluid supply path 105*a* to the tank.

The differential pressure reducing valve 111 outputs P1−Plmax1 as the LS differential pressure Pls1 based on Plmax1 introduced to the differential pressure reducing valve 111. At the moment of a start of the boom in the raising direction, P1 has been maintained at a low pressure determined beforehand by the spring of the unloading valve, wherefore Pls1 becomes substantially equivalent to the tank pressure.

The LS differential pressure Pls1 is introduced to the LS valve 112*b* included in the flow rate control regulator 112 of the main pump 101 of the variable displacement type.

As described above, Pls1=tank pressure<Pgr holds at the start of boom raising. Accordingly, the LS valve 112*b* is switched toward the right in the figure.

The LS valve output pressure selector valve 112*a* is located at the neutral position (position switched toward left in the figure by the spring). In this condition, the hydraulic fluid of the flow rate control piston 112*c* is discharged to the tank via the LS valve output pressure selector valve 112*a* and the LS valve 112*b*.

Accordingly, the flow rate of the main pump 101 of the variable displacement type increases. This flow rate increase continues until Pls1 becomes equivalent to Pgr.

Similarly, in response to switching of the flow control valve 206*a*, hydraulic fluid is supplied to the bottom side of the boom cylinder 3*a* via the flow control valve 206*a*. Simultaneously, a load pressure on the bottom side of the boom cylinder 3*a* is introduced to the selector valve 220 via the load pressure detection port formed in the flow control valve 206*a* and the shuttle valve 209*a*. At this time, the selector valve 220 has been switched downward in the figure as described above. Accordingly, the load pressure on the bottom side of the boom cylinder 3*a* is introduced to the unloading valve 215 and the differential pressure reducing valve 211 as the maximum load pressure Plmax2.

The set pressure of the unloading valve 215 increases to the sum of the load pressure of the boom cylinder 3*a* and the spring force in accordance with Plmax2 introduced to the unloading valve 215, and interrupts the hydraulic line for discharging the hydraulic fluid of the hydraulic fluid supply path 205*a* to the tank.

The differential pressure reducing valve 211 outputs P2−Plmax2 as the LS differential pressure Pls2 based on Plmax2 introduced to the differential pressure reducing valve 211. At the moment of a start of the boom 511 in the raising direction, P2 has been maintained at a low pressure determined beforehand by the spring of the unloading valve, wherefore Pls2 becomes substantially equivalent to the tank pressure.

The LS differential pressure Pls2 is introduced to the LS valve 212*b* included in the flow rate control regulator 212 of the main pump 201 of the variable displacement type.

As described above, Pls2=tank pressure<Pgr holds at the start of boom raising. Accordingly, the LS valve 212*b* is switched toward the left in the figure.

The LS valve output pressure selector valve 212*a* is located at the neutral position (position switched toward the right in the figure by the spring). In this condition, the hydraulic fluid of the tilt control piston 212*c* is discharged to the tank via the LS valve output pressure selector valve 212*a* and the LS valve 212*b*.

Accordingly, the flow rate of the main pump 201 of the variable displacement type increases. This flow rate increase continues until Pls2 becomes equivalent to Pgr.

As described above, in the combined operation of the boom raising and swing, the swing motor 3*c* and the boom cylinder 3*a* are driven by the different pumps (swing motor 3*c* driven by main pump 301, and boom cylinder 3*a* driven by main pumps 101 and 201). Accordingly, preferable combined operation is achievable by reducing speed interference between swing and the front implement.

The output of the torque estimation section 310 of the main pump 301 is introduced to the horsepower control piston 112*f* included in the regulator 112 of the main pump 101, and the horsepower control piston 212*f* included in the regulator 212 of the main pump 201. Accordingly, the main pump 101 and the main pump 201 perform horsepower control and load sensing control within a range of torque calculated by subtracting torque of the main pump 301 from predetermined torque. In this manner, torque of the main pump 301 is accurately detected by a pure hydraulic system, and fed back to the main pumps 101 and 201. Accordingly, accurate entire torque control, and effective use of output torque of the prime mover are achievable.

(e) Traveling

Considered herein will be straight traveling by simultaneous full-operations of the operation levers of the left and right traveling operation devices 524*a* and 524*b*.

It is assumed that traveling operation pressures f1 and g1 are output from the traveling operation pilot valves 60*f* and 60*g*. The traveling operation pressures f1 and g1 are introduced to the right end of the traveling motor control directional control valve 116, and the left end of the directional control valve 216, respectively. As a result, the directional control valve 116 is switched toward the left in the figure, while the directional control valve 216 is switched toward the right in the figure.

With switching of the directional control valves 116 and 216, the signal selector valves 117 and 217 are simultaneously switched to interruption positions. In this case, the pressure of the signal hydraulic line 150*a* increases to the fixed pilot pressure Pi0, and switches the selector valve 140 toward the right in the figure, the LS valve output pressure selector valve 112*a* toward the right in the figure, the LS valve output pressure selector valve 212*a* toward the left, the selector valves 120, 220, and 320 upward in the figure, and the maximum capacity selector pistons 112*g* and 212*g* downward.

With switching of the selector valve 140 toward the right in the figure, the hydraulic fluid delivered from the main pump 101 is introduced to the traveling motor 3*f* via the hydraulic fluid supply path 118 and the directional control valve 116, while the hydraulic fluid delivered from the main pump 201 is introduced to the traveling motor 3*g* via the hydraulic fluid supply path 218 and the directional control valve 216 to drive the traveling motors 3*f* and 3*g*.

Moreover, the maximum capacity selector pistons 112*g* and 212*g* are switched downward, wherefore the maximum capacity of each of the main pumps 101 and 201 changes to Mt.

Furthermore, the LS valve output pressure selector valve 112*a* is switched toward the right in the figure. In this case, connection between the LS valve 112*b* and the flow rate control piston 112*c* is interrupted, whereby the hydraulic fluid of the flow rate control piston 112*c* is discharged to the tank. As a result, the LS valve output pressure selector valve 212*a* is switched toward the left in the figure. Accordingly, connection between the LS valve 212*b* and the flow rate control piston 212*c* is interrupted, whereby the hydraulic fluid of the flow rate control piston 212*c* is discharged to the tank.

In this manner, the main pumps 101 and 201 stop load sensing control, and only horsepower control is performed in the state that the maximum capacity has been switched to Mt.

When the selector valve 140 is switched toward the right in the figure, connection between the hydraulic fluid supply path 305 of the main pump 301 and the hydraulic fluid supply paths 105*a* and 205*a* is made.

When the selector valves 120, 220, and 320 are switched upward in the figure, the maximum load pressure of all the actuators other than actuators for traveling, i.e., the highest pressure in Plmax1, Plmax2, and Plmax3 is selected as the maximum load pressure introduced to the unloading valve 115 connected to the hydraulic fluid supply path 105*a*, the differential pressure reducing valve 111, the unloading valve 215 connected to the hydraulic fluid supply path 205*a*, the differential pressure reducing valve 211, the unloading valve 315 connected to the differential pressure reducing valve 305, and the differential pressure reducing valve 311, and introduces the selected maximum load pressure as Plmax0.

When actuators other than actuators for traveling are not operated in the straight traveling operation, each of Plmax1, Plmax2, and Plmax3 is the tank pressure. The delivery pressure P3 of the main pump 301 is kept slightly higher than an output pressure Pg of the prime mover revolution speed detection valve 13 by the springs provided on the unloading valves 115, 215, and 315.

When the operation levers other than levers for traveling are in neutral, Pls3 of the differential pressure reducing valve 311 becomes Pls3=P3−Plmax0=P3>Pgr based on the state that Plmax0 is equivalent to the tank pressure as described above.

In this case, Pls3 is introduced to the LS valve 312*b* included in the regulator 312 of the main pump 301. When operation levers other than levers for traveling are in neutral, Pls3 is higher than Pgr. Accordingly, the LS valve 312*b* is switched toward the right in the figure, whereby the pilot pressure Pi0 generated by the pilot relief valve 32 and maintained at a fixed value is introduced to the load sensing tilt control piston 312*c*.

Hydraulic fluid is introduced to the load sensing tilt control piston 312*c*. Accordingly, the capacity of the main pump 301 of the variable displacement type is maintained at the minimum.

In the traveling operation, as described above, the selector valve 140 is switched toward the right in the figure (second position). In addition, load sensing control of each of the main pumps 101 and 201 is stopped, and the left and right traveling motors 3*f* and 3*g* are driven only by horsepower control in the state that the maximum capacity has been switched to Mt. Accordingly, highly efficient traveling operation is achievable without producing a meter-in loss produced by a load sensing differential pressure.

(f) Combined Operation of Traveling and Boom Raising

Considered herein will be a full-operation of the operation lever of the boom operation device 523*a* in the boom raising direction while traveling straight by simultaneous full-operations of the left and right traveling operation devices 524*a* and 524*b*.

An operation by traveling operation is similar to the operation in (e) traveling operation.

More specifically, the positions of the signal selector valves 117 and 217 are switched to the interruption positions. The pressure of the signal hydraulic line 150*a* increases to the fixed pilot pressure Pi0, and switches the selector valve 140 toward the right in the figure, the LS valve output pressure selector valve 112*a* toward the right in the figure, the LS valve output pressure selector valve 212*a* toward the left, the selector valves 120, 220, and 320 upward in the figure, and the maximum capacity selector pistons 112*g* and 212*g* downward.

With switching of the selector valve 140 toward the right in the figure, the hydraulic fluid delivered from the main pump 101 is introduced to the traveling motor 3*f* via the hydraulic fluid supply path 118 and the directional control valve 116, while the hydraulic fluid delivered from the main pump 201 is introduced to the traveling motor 3*g* via the hydraulic fluid supply path 218 and the directional control valve 216 to drive the traveling motors 3*f* and 3*g*.

Moreover, the maximum capacity selector pistons 112*g* and 212*g* are switched downward. In this case, the maximum capacity of each of the main pumps 101 and 201 is changed to Mt, and the LS valve output pressure selector valves 112*a* and 212*a* are switched. The hydraulic fluids of the flow rate control pistons 112*c* and 212*c* are discharged to the tank. Accordingly, each of the main pumps 101 and 201 stops load sensing control, and horsepower control is performed with the maximum capacity set to Mt within a range of torque calculated by subtracting torque of the main pump 301.

On the other hand, when the selector valves 120, 220, and 320 are switched upward in the figure with switching of the selector valve 140 toward the right in the figure, connection between the hydraulic fluid supply path 305 of the main pump 301 and the hydraulic fluid supply paths 105*a* and 205*a* is made. In addition, the maximum load pressure Plmax0 of all the actuators other than actuators for traveling is introduced to the unloading valves 115, 215, and 315 and the differential pressure reducing valve 311. Accordingly, all the actuators other than actuators for traveling are driven by load sensing control performed by the main pump 301.

When the boom raising operation is performed during the traveling operation, the boom raising operation pressure a1 output from the boom cylinder operation pilot valve 60*a* is introduced to the left end of the boom flow control valve 106*a* in the figure. In this case, the flow control valve 106*a* is switched toward the right in the figure, whereby the boom raising pilot pressure a1 input to the pilot pressure reducing valve 70*c* is introduced to the left end of the flow control valve 206*a* in the figure without regulation not in the state of arm crowding operation. Accordingly, the flow control valve 206*a* is switched toward the right in the figure.

When the flow control valves 106*a* and 206*a* are switched, the hydraulic fluid is supplied to the bottom side of the boom cylinder 3*a* via the flow control valves 106*a* and 206*a*. Simultaneously, the load pressure on the bottom side of the boom cylinder 3*a* is introduced to the unloading valves 115, 215, and 315, and the differential pressure reducing valves 111, 211, and 311 as the maximum load pressure Plmax0 via the load pressure detection ports formed in the flow control valves 106*a* and 206*a* and the shuttle valves 109*a*, 109*b*, and 209*a* through the selector valves 120, 220, and 320.

The set pressure of each of the unloading valves 115, 215, and 315 increases to the sum of the load pressure of the boom cylinder 3*a* and the spring force in accordance with Plmax0 introduced to the unloading valves 115, 215, and 315, and interrupts the hydraulic lines for discharging the hydraulic fluids of the hydraulic fluid supply paths 105*a*, 205*a*, and 305*a* to the tank.

The differential pressure reducing valve 311 outputs P3−Plmax0 as the LS differential pressure Pls3 based on Plmax0 introduced to the differential pressure reducing valve 311. At the moment of a start of the boom 511 in the raising direction, P3 has been maintained at a low pressure determined beforehand by the spring of the unloading valve, wherefore Pls3 becomes substantially equivalent to the tank pressure.

The LS differential pressure Pls3 is introduced to the LS valve 312*b* included in the flow rate control regulator 312 of the main pump 301 of the variable displacement type.

As described above, Pls3=tank pressure<Pgr holds at the start of the boom raising. Accordingly, the LS valve 312*b* is switched toward the left in the figure, whereby hydraulic fluid of the tilt control piston 312*c* is discharged to the tank via the LS valve 312*b*.

As a result, the flow rate of the main pump 301 of the variable displacement type increases. This flow rate increase continues until Pls3 becomes equivalent to Pgr.

As described above, when traveling and boom raising operation are simultaneously performed, each of the main pumps 101 and 201 stops load sensing control after switching the maximum capacity to Mt. Thereafter, the left and right traveling motors 3*f* and 3*g* are driven by an open center circuit, and the main pump 301 supplies hydraulic fluid to the boom cylinder 3*a* under load sensing control at the flow rate required by the control to drive the boom cylinder 3*a*.

As described above, in the combined operation of traveling and boom raising, the boom cylinder 3*a* is driven by load sensing control using the main pump 301. In this case, even when an operation amount of the boom operation lever is small, the delivery rate of the main pump 301 is controlled in accordance with the operation amount. Accordingly, efficient work is achievable while reducing a bleed-off loss produced by the unloading valves. Moreover, similarly to the maximum capacity Mf of each of the main pumps 101 and 201, the main capacity Ms of the main pump 301 is set such that a necessary flow rate can be supplied to the boom cylinder 3*a* or the arm cylinder 3*b* corresponding to the actuator requiring the largest flow rate in the actuators driven by the main pumps 101 and 201 (Ms=Mf). Accordingly, an excellent combined operation is achievable by obtaining a sufficient boom raising speed.

~Advantage~

According to the present embodiment configured as described above, following advantages are offered.

1. In the combined operation of boom raising and arm crowding, or boom lowering and arm dumping, such as horizontal leveling operation as an operation not including traveling, the boom cylinder 3*a* and the arm cylinder 3*b* are driven by load sensing control using different pumps (first and second pumps). Accordingly, highly efficient combined operations in the front implement 504 can be performed since a bleed-off loss at the unloading valves is reduced and a meter-in loss (restrictor loss) at the pressure compensating valve of the low-load side actuator is prevented to occur. This is applicable also to other operations performed by the front implement and not including traveling, such as excavating work and leveling work.

2. In the combined operation combining swing and the front implement 504 (operation not including traveling), such as the combined operation of boom raising and swing, the swing motor 3*c* and the front implement actuators 3*a*, 3*b*, and 3*d* are driven by different pumps (swing motor 3*c* by main pump 301, front implement actuators 3*a*, 3*b*, and 3*d* by main pumps 101 and 201). Accordingly, speed interference between swing and the front implement 504 is suppressed and excellent combined operability can be attained.

3. In the operation including traveling, such as straight traveling operation, the selector valve 140 (selector valve device) is switched toward the right in the figure (second position), load sensing control of each of the main pumps 101 and 201 (first and second pumps) is stopped, and the left and right traveling motors 3*f* and 3*g* are driven only by horsepower control in the state that the maximum capacity has been switched to Mt. Accordingly, a highly efficient traveling operation can be performed without producing a meter-in loss produced by a load sensing differential pressure.

4-1. In the operation including traveling, such as the combined operation of traveling and boom raising, not only a highly efficient traveling operation can be performed as described above, but also since the front implement actuators 3*a*, 3*b*, and 3*d* are driven by load sensing control using the main pump 301 (third pump), and even when the operation amount of the front implement 504 is small, the delivery rate of the main pump 301 is controlled in accordance with the operation amount, a bleed-off loss produced by the unloading valves is reduced and a highly efficient combined operation can be performed.

4-2. In the operation including traveling, such as the combined operation of traveling and boom raising, similarly to the maximum capacity Mf of each of the main pumps 101 and 201, the maximum capacity Ms of the main pump 301 is set on the basis of the boom cylinder 3*a* or the arm cylinder 3*b* requiring the largest flow rate in the actuators driven by the main pumps 101 and 201 such that a necessary flow rate can be supplied to the boom cylinder 3*a* or the arm cylinder 3*b* (Ms=Mf). Accordingly, sufficient operation speeds of the front implement actuators 3*a*, 3*b*, and 3*d* is attained and an excellent combined operation can be achieved.

As described above, according to the present embodiment, in the hydraulic drive system of the work machine which drives a plurality of actuators using three or more pumps, a highly efficient combined operation of the front implement 504 and excellent combined operability of the front implement 504 and swing can be achieved in the operation not including traveling, and a highly efficient traveling operation and a highly efficient combined operation of traveling and the front implement 504 can be achieved while attaining a sufficient operation speed of the front implement 504 in the operation including traveling.

Moreover, following advantages can be offered according to the present embodiment.

5. When the arm of the front implement is an extremely long, a larger number of boom raising operations may be required in accordance with arm crowding operation to perform leveling operation. According to Patent Document 2, the meter-in opening of the boom assist flow control valve opens in this situation. In the leveling operation, therefore, a meter-in loss is produced at the pressure compensating valve of the arm corresponding to the low-load pressure actuator. In this case, a highly efficient combined operation may be difficult to achieve.

According to the present embodiment, the boom cylinder 3*a* and the arm cylinder 3*b* are securely driven by the different main pumps 101 and 201 at the time of the simultaneous operation of the boom 511 and the arm 512 as described in the leveling operation. Accordingly, a highly efficient combined operation is achievable without producing a restrictor loss (meter-in loss) at the arm side pressure compensating valve 207*b*.

6. According to Patent Document 1, the front implement actuators such as the boom cylinder and the arm cylinder are driven by load sensing control of the two main pumps (two delivery ports) in the non-traveling operation. On the other hand, the traveling motor is driven by the open center circuit using the two main pumps functioning as fixed displacement pumps in the traveling operation. In this case, the maximum capacity of each of the two main pumps needs to be set in accordance with a flow rate necessary for the traveling motor corresponding to a driving actuator when the two main pumps function as fixed displacement pumps. Accordingly, when actuators requiring a relatively large flow rate are driven, such as the boom cylinder and the arm cylinder, even the flow rate of the combined hydraulic fluids of the two main pumps may be insufficient for required flow rates of these actuators. In this case, a speedy operation, such as excavation and loading operation, may be difficult to achieve.

According to the present embodiment, however, the maximum capacity of each of the two main pumps 101 and 201 is switched to either value, Mf or Mt (Mf>Mt), in accordance to the operating condition, whether it is non-traveling operation or traveling operation. In this case, the pump maximum flow rate necessary for driving the front implement actuators 3*a*, 3*b*, and 3*d* can be set to any rates regardless of the flow rate necessary for the traveling motors 3*f* and 3*g*. Accordingly, a speedy excavation or loading operation is achievable.

Embodiment 2

Embodiment 2 of the present invention will be next described. Different points from Embodiment 1 will be chiefly touched upon.

~Structure~

Figure 5:
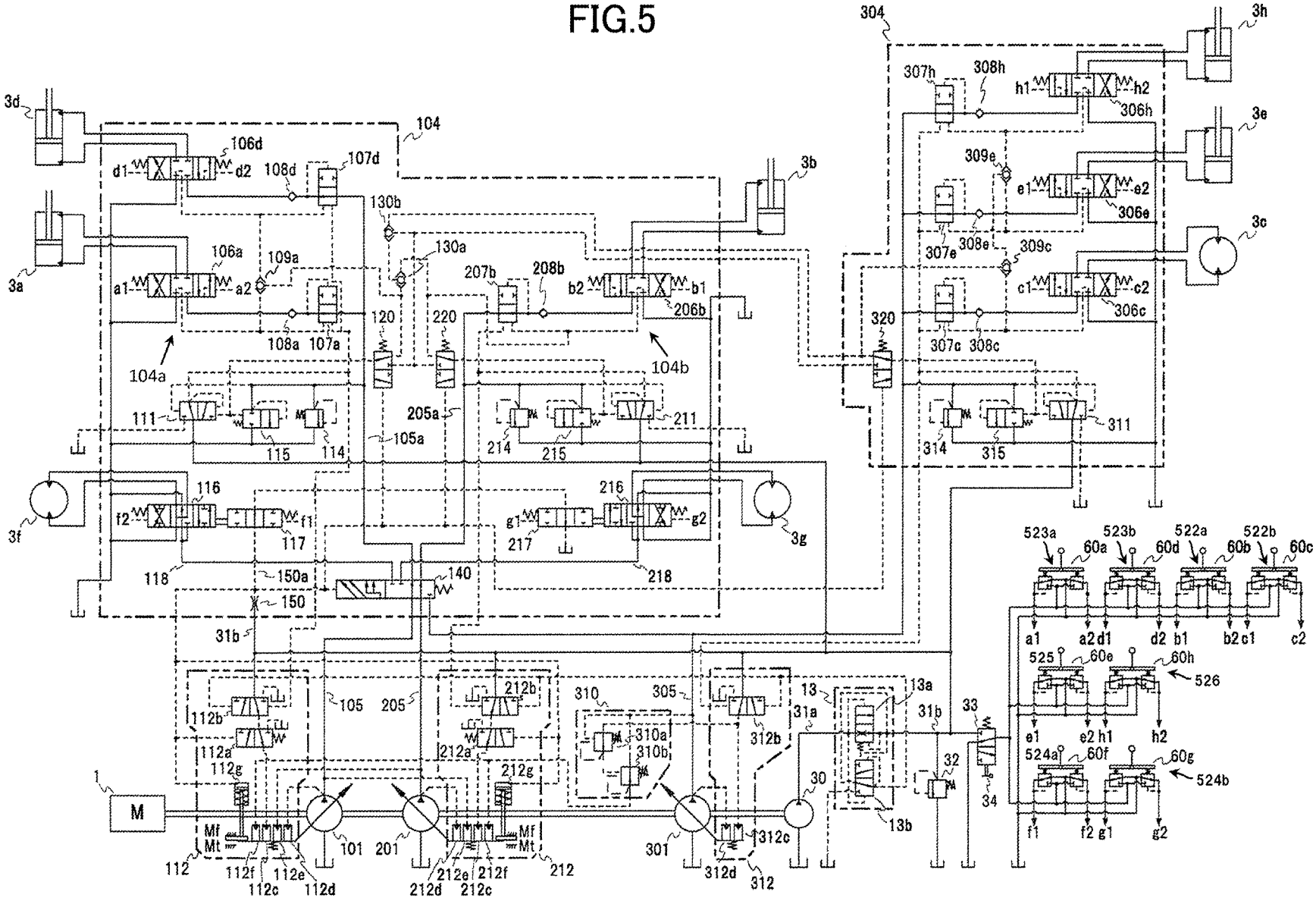
FIG. 5 is a diagram showing a general structure of a hydraulic drive system according to Embodiment 2 of the present invention.

FIG. 5 is a diagram showing a general structure of a hydraulic drive system according to Embodiment 2 of the present invention.

The hydraulic drive system of the present embodiment is different from the structure of Embodiment 1 in that the assist driving flow control valve 206*a* of the boom cylinder 3*a* connected to the hydraulic fluid supply path 205*a*, the assist driving flow control valve 106*b* of the arm cylinder 3*b* connected to the hydraulic fluid supply path 105*a*, and the pilot pressure reducing valves 70*a*, 70*b*, and 70*c* are eliminated. The first valve section 104*a* includes a single flow control valve 106*a* as the boom flow control valve, while the second valve section 104*b* includes a single flow control valve 206*b* as the arm flow control valve.

Other structures are similar to the corresponding structures of Embodiment 1.

~Operation~

An operation of Embodiment 2 will be hereinafter described.

The hydraulic drive system of the present embodiment is different from that of Embodiment 1 in that the operations associated with the assist driving flow control valves 206*a* and 106*b* of the boom cylinder 3*a* and the arm cylinder 3*b* are eliminated.

No pilot pressure reducing valve is provided, wherefore the characteristic of the pilot pressure reducing valve shown in FIG. 4 is not referred to.

Other points are performed similarly to Embodiment 1.

~Advantage~

According to Embodiment 2 of the present invention, the front implement actuators including the boom cylinder 3*a* and the arm cylinder 3*b* are driven by load sensing control using the different main pumps 101 and 201 in all operations. Accordingly, highly efficient work is achievable by reducing a bleed-off loss, and preventing a restrictor loss at the pressure compensating valve of the low-load side actuator.

Advantages similar to the advantages of Embodiment 1 can be offered in other points.

Embodiment 3

Embodiment 3 of the present invention will be next described. Points different from Embodiment 1 will be chiefly touched upon.

In Embodiment 1 and Embodiment 2, the first, second, and third pumps 101, 201, and 301 are pumps of a variable displacement type driven by the prime mover 1, respectively and the first, second, and third delivery rate control devices 112, 212, and 312 are configured to hydraulically control the capacities of the first, second, and third pumps 101, 201, and 301, respectively, to perform the load sensing control of the first, second, and third pumps 101, 201, and 301. According to the present embodiment, however, the first, second, and third pumps are pumps of a fixed displacement type driven by the first, second, and third electric motors, respectively, and the first, second, and third delivery rate control devices are configured by a controller to electrically control the revolution speeds of the first, second, and third electric motors, respectively, to perform the load sensing control of the first, second, and third pumps.

~Structure~

Figure 6:
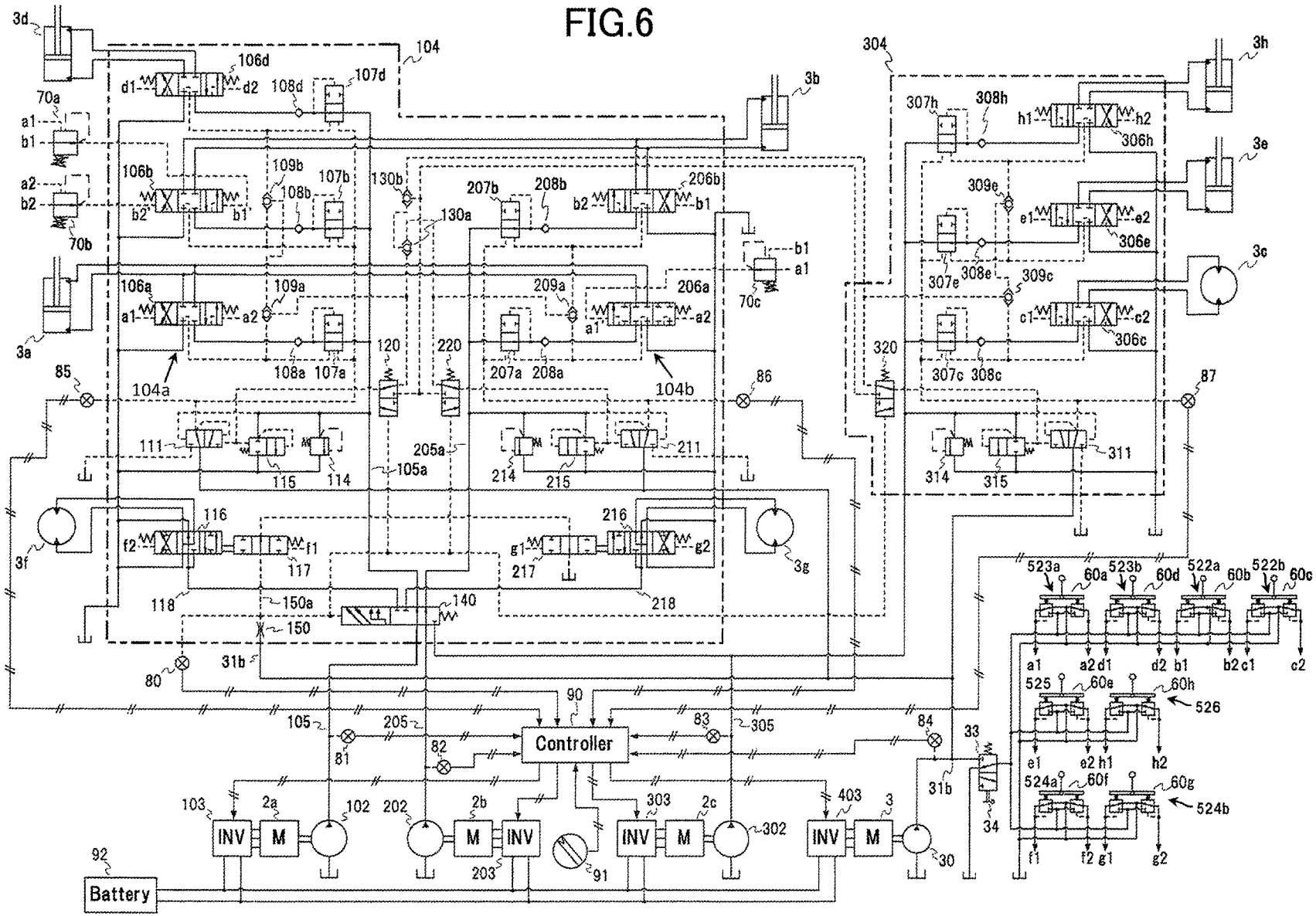
FIG. 6 is a diagram showing a general structure of a hydraulic drive system according to Embodiment 3 of the present invention.

FIG. 6 is a diagram showing a general structure of a hydraulic drive system according to Embodiment 3 of the present invention.

The hydraulic drive system of the present embodiment includes the main pumps 102, 202, and 302 of the fixed displacement type corresponding to the first, second, and third pumps, the pilot pump 30 of a fixed displacement type, an electric motor 2*a* corresponding to a first electric motor for driving the main pump 102, an electric motor 2*b* corresponding to a second electric motor for driving the main pump 202, an electric motor 2*c* corresponding to a third electric motor for driving the main pump 302, an electric motor 3 corresponding to a fourth electric motor for driving the pilot pump 30, an inverter 103 for controlling a revolution speed of the electric motor 2*a*, an inverter 203 for controlling a revolution speed of the electric motor 2*b*, an inverter 303 for controlling a revolution speed of the electric motor 2*c*, an inverter 403 for controlling a revolution speed of the electric motor 3, and a battery 92 for supplying power to the inverters 103, 203, 303, and 403.

The hydraulic drive system of the present embodiment further includes a pressure sensor 80 for detecting a pressure of the signal hydraulic line 150*a*, a pressure sensor 81 for detecting a pressure of the hydraulic fluid supply path 105 of the main pump 102, a pressure sensor 82 for detecting a pressure of the hydraulic fluid supply path 205 of the main pump 202, a pressure sensor 83 for detecting a pressure of the hydraulic fluid supply path 305 of the main pump 302, a pressure sensor 84 for detecting a pressure of the hydraulic fluid supply path 31*b* of the pilot pump 30, a pressure sensor 85 for detecting the LS differential pressure Pls1 corresponding to an output pressure of the differential pressure reducing valve 111 connected to the hydraulic fluid supply path 105*a*, a pressure sensor 86 for detecting the LS differential pressure Pls2 corresponding to an output pressure of the differential pressure reducing valve 211 connected to the hydraulic fluid supply path 205*a*, a pressure sensor 87 for detecting the LS differential pressure Pls3 corresponding to an output pressure of the differential pressure reducing valve 311 connected to the hydraulic fluid supply path 305, a dial 91 for adjusting maximum speeds of respective actuators, and a controller 90 which receives an operation signal of the dial 91 and detection signals of the pressure sensors 80, 81, 82, 83, 84, 85, 86, and 87, and outputs control signals to the inverters 103, 203, 303, and 403.

Figure 7:
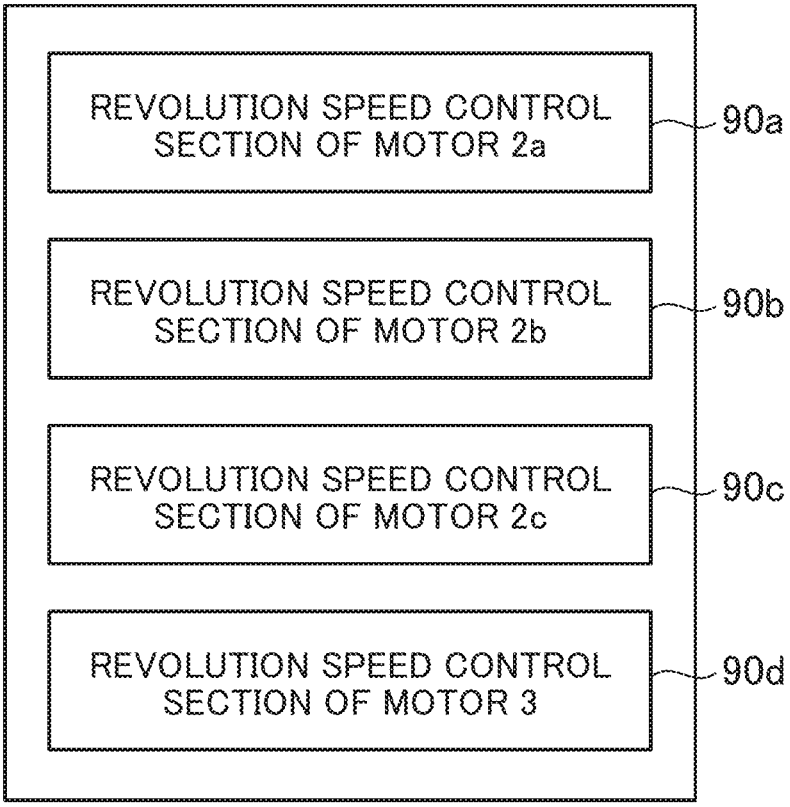
FIG. 7 is a block diagram showing an outline of functions of a controller.

FIG. 7 is a block diagram showing an outline of functions of the controller 90.

As shown in FIG. 7, the controller 90 includes respective functions of a revolution speed control section 90*a* of the electric motor 2*a* (revolution speed control section of first electric motor), a revolution speed control section 90*b* of the electric motor 2*b* (revolution speed control section of second electric motor), a revolution speed control section 90*c* of the electric motor 2*c* (revolution speed control section of third electric motor), and a revolution speed control section 90*d* of the electric motor 3 (revolution speed control section of fourth electric motor)

The revolution speed control section 90*a* of the electric motor 2*a*, the revolution speed control section 90*b* of the electric motor 2*b*, and the revolution speed control section 90*c* of the motor 2*c* provide first, second, and third delivery rate control devices that individually change the delivery rates of the main pumps 101, 201, and 301 as the first, second, and third pumps, respectively.

The revolution speed control section 90*a* of the electric motor 2*a* and the revolution speed control section 90*b* of the electric motor 2*b* (first and second delivery rate control devices) are configured to perform load sensing control such that delivery pressures of the first and second pumps 101 and 201 become higher than the maximum load pressure of respective actuators driven by delivery fluids of the first and second pumps 101 and 201 in the plurality of first actuators 3*a*, 3*b*, and 3*d* by a given set value when the traveling operation detection device 117, 217 and 150*a* does not detect the traveling operation and the selector valve device 140 is located at the first position, and stop the load sensing control of the first and second pumps 101 and 201 and drive the plurality of second actuators 3*f* and 3*g* in the state that the maximum capacity has been switched to Mt when the traveling operation detection device 117, 217 and 150*a* detects the traveling operation and the selector valve device 140 switches to the second position.

The revolution speed control section 90*d* of the electric motor 3 (third delivery rate control device) is configured to perform load sensing control such that the delivery pressure of the third pump 301 becomes higher than the maximum load pressure of the plurality of third actuators 3*c*, 3*e*, and 3*h* by a given set value when the traveling operation detection device 117, 217 and 150*a* does not detect the traveling operation and the selector valve 140 is located at the first position, and perform load sensing control such that the delivery pressure of the third pump 301 becomes higher than the maximum load pressure of the plurality of first and third actuators 3*a*, 3*b*, and 3*d* and 3*c*, 3*e* and 3*h* by a given set value when the traveling operation detection device 117, 217 and 150*a* detects the traveling operation and the selector valve device 140 switches to the second position.

Other structures of the present embodiment are similar to the corresponding structures of Embodiment 1.

~Operation~

An operation of Embodiment 3 will be hereinafter described with reference to FIGS. 8, 9, 10, and 11A to 11G.

Figure 8:
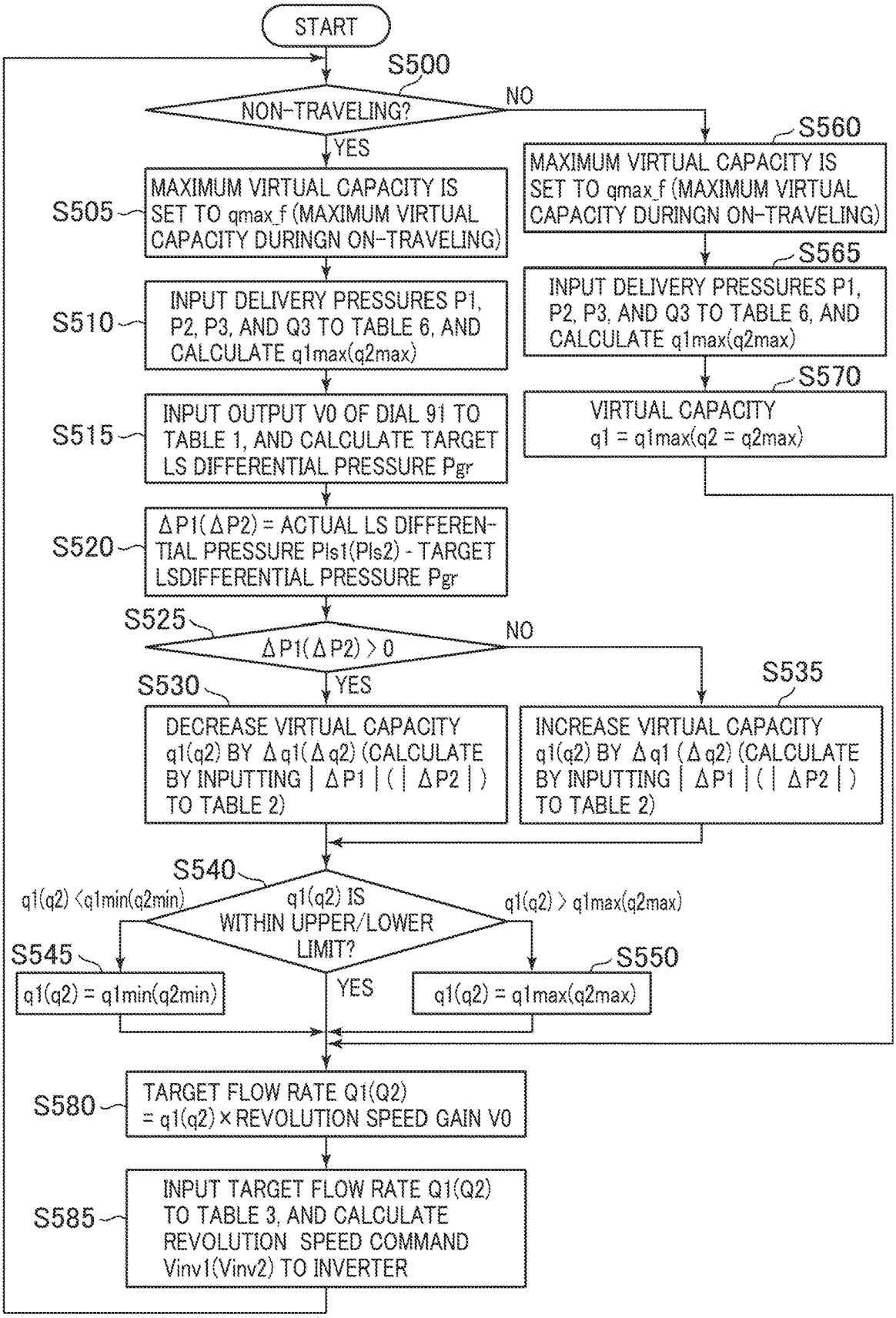
FIG. 8 is a flowchart showing functions of a revolution speed control section of a first electric motor, and a revolution speed control section of a second electric motor.
Figure 9:
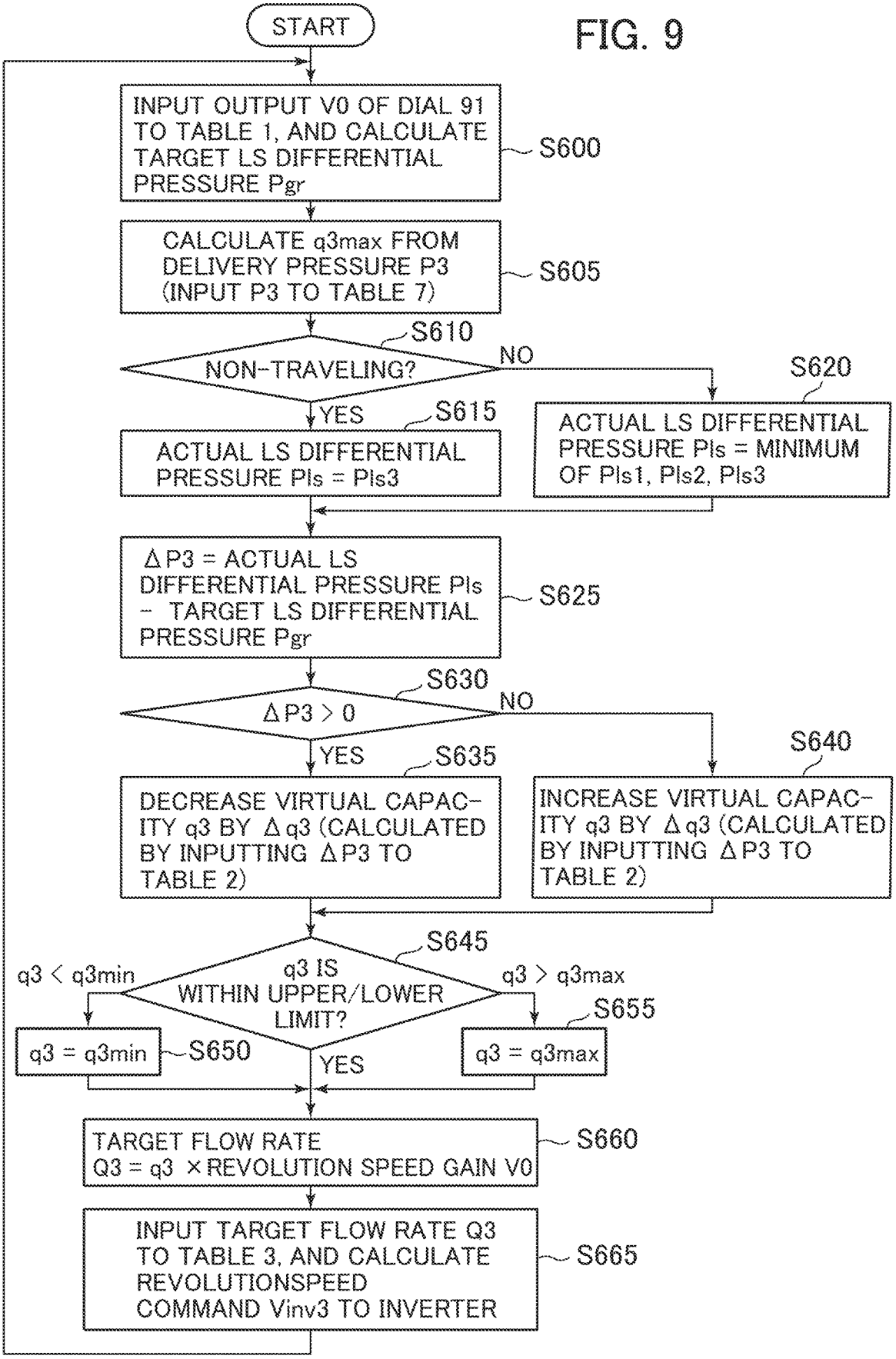
FIG. 9 is a flowchart showing a function of a revolution speed control section of a third electric motor.
Figure 10:
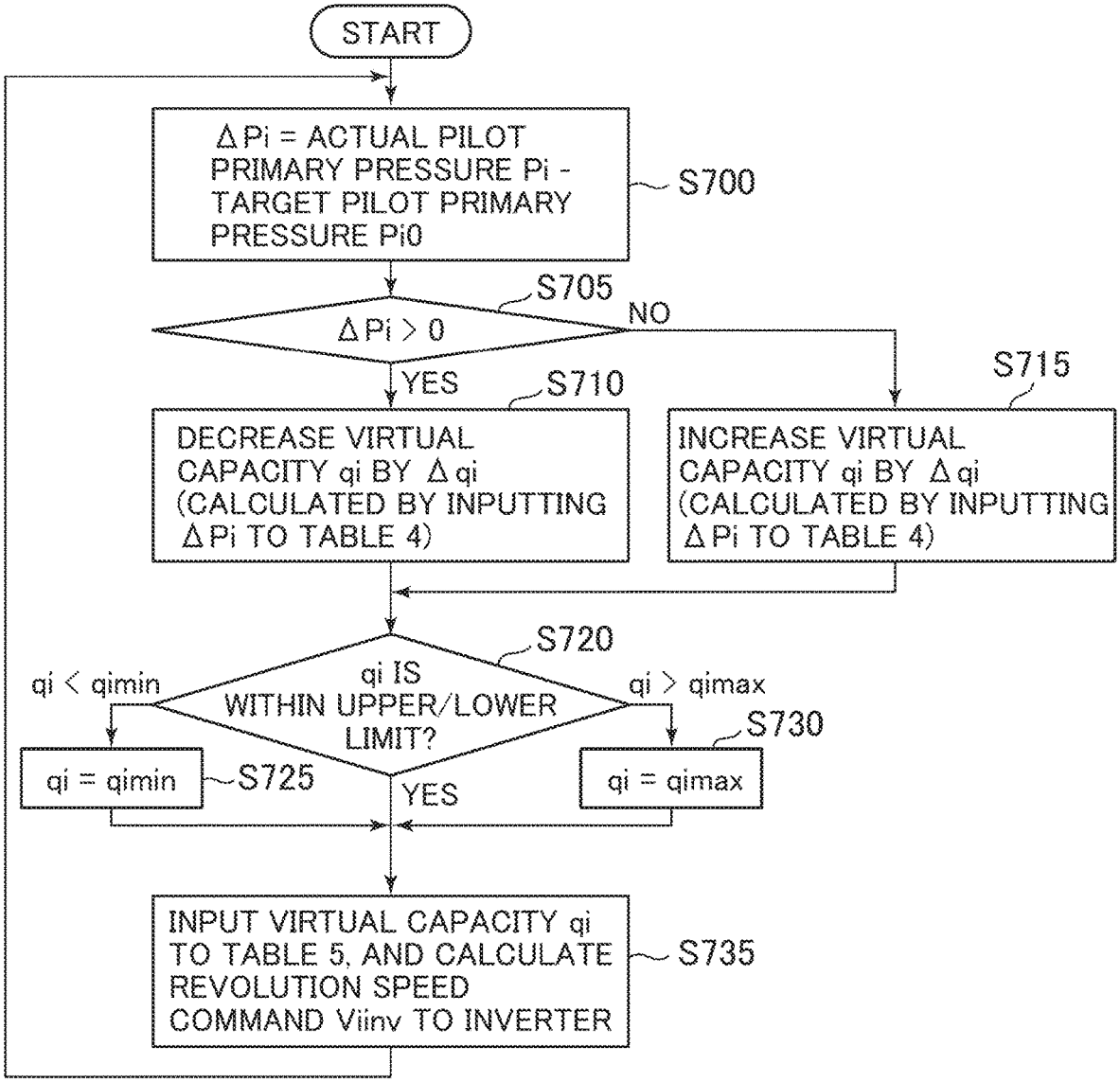
FIG. 10 is a flowchart showing a function of a revolution speed control section of a fourth electric motor.

FIG. 8 is a flowchart showing functions of the revolution speed control section 90*a* of the electric motor 2*a*, and the revolution speed control section 90*b* of the electric motor 2*b*. FIG. 9 is a flowchart showing a function of the revolution speed control section 90*c* of the electric motor 2*c*. FIG. 10 is a flowchart showing a function of the revolution speed control section 90*d* of the electric motor 3. FIGS. 11A to 11G are charts each showing a table characteristic used by the revolution speed control section 90*a* of the electric motor 2*a*, the revolution speed control section 90*b* of the electric motor 2*b*, the revolution speed control section 90*c* of the motor 2*c*, and the revolution speed control section 90*d* of the motor 3.

A control method of the electric motor 3 which drives the pilot pump 30 will be initially described with reference to FIG. 10.

The revolution speed control section 90*d* of the controller 90 for the motor 3 acquires an actual pilot primary pressure Pi from a detection signal output from the pressure sensor 84, and calculates a difference between the actual pilot primary pressure Pi and a target pilot primary pressure Pi0 to obtain ΔPi (step S700).

When ΔPi>0, a virtual capacity qi of the pilot pump 30 is decreased by Δqi (steps S705, S710). When ΔPi≤0, the virtual capacity qi of the pilot pump is increased by Δqi (steps S705, S715). In these steps, Δqi is obtained from Table 4 shown in FIG. 11D. Table 4 establishes such a characteristic that an increment Δqi of the virtual capacity increases as an absolute value of ΔPi increases. When the differential pressure reaches ΔPi_1, the increment Δqi becomes a maximum Δqi_max.

It is determined whether the obtained virtual capacity qi of the pilot pump 30 lies within a range between upper and lower limits (step S720). When the virtual capacity qi is smaller than a lower limit qmin, qi is set to qimin (step S725). When qi is larger than an upper limit qimax, qi is set to qimax (step S730). Each of qimin and qimax is a value determined beforehand.

Figure 11B:
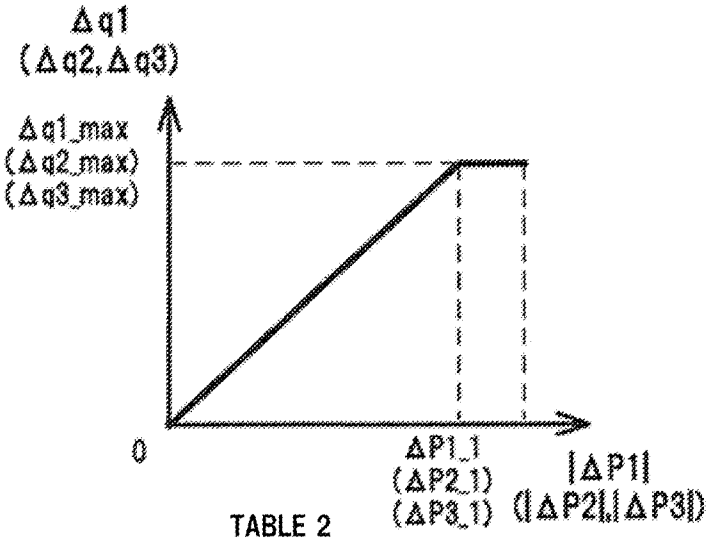
FIG. 11B is a chart showing a table characteristic of a differential pressure deviation as a difference between an actual LS differential pressure and a target LS differential pressure, and an incremental of a virtual capacity, the table characteristic being used by the revolution speed control section of each of the first electric motor, second electric motor, and third electric motor.
Figure 11A:
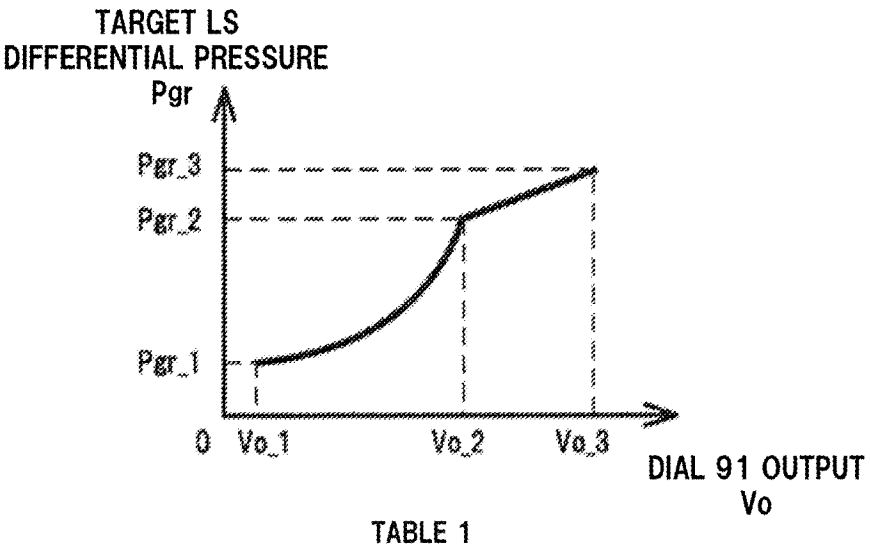
FIG. 11A is a chart showing a table characteristic of a dial output and a target LS differential pressure, the table characteristic being used by the revolution speed control section of each of the first electric motor, second electric motor, and third electric motor.
Figure 11D:
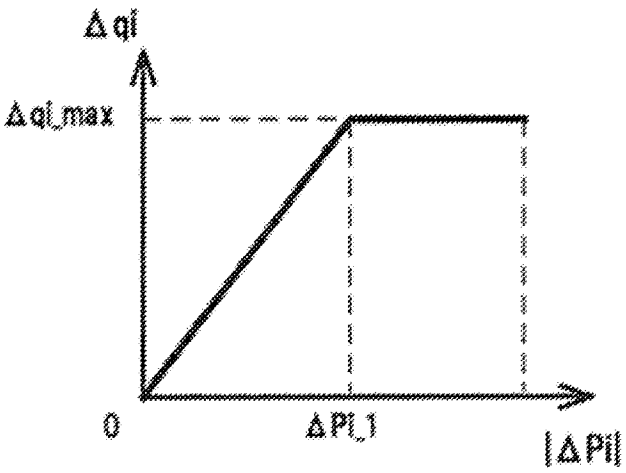
FIG. 11D is a chart showing a table characteristic of a difference between an actual pilot primary pressure and a target pilot primary pressure, and the incremental of the virtual capacity, the table characteristic being used by the revolution speed control section of the fourth electric motor.
Figure 11C:
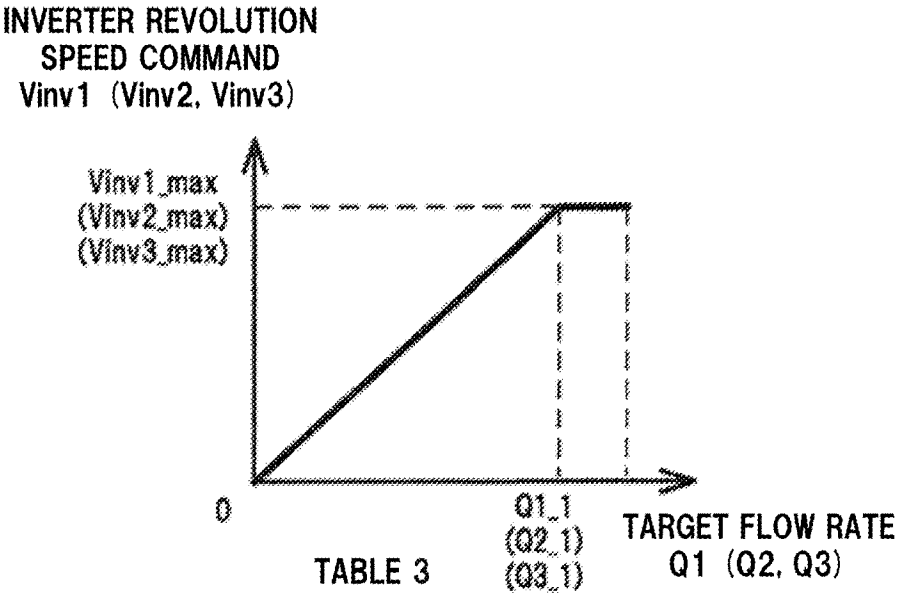
FIG. 11C is a chart showing a table characteristic of a target flow rate and a revolution speed command given to an inverter, the table characteristic being used by the revolution speed control section of each of the first electric motor, second electric motor, and third electric motor.
Figure 11E:
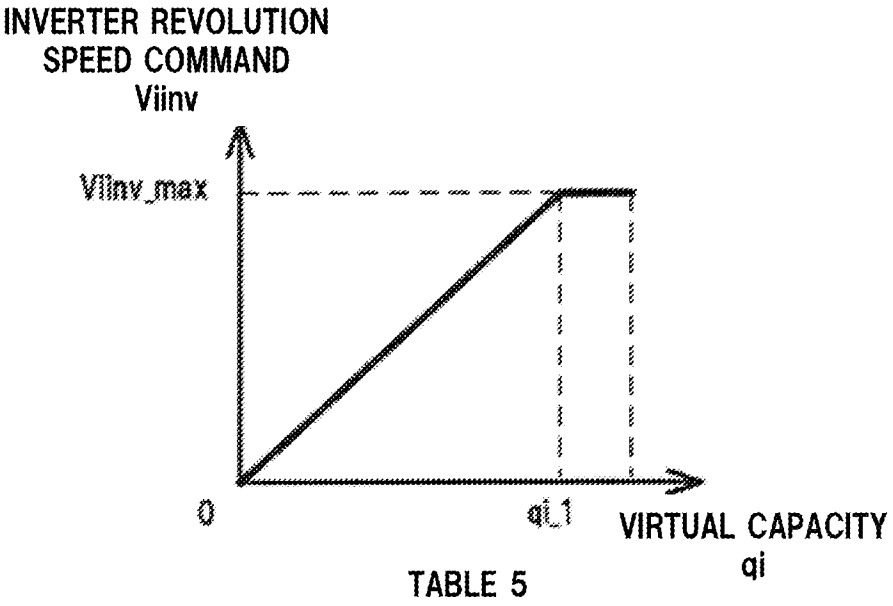
FIG. 11E is a chart showing a table characteristic of the virtual capacity and the revolution speed command given to the inverter, the table characteristic being used by the revolution speed control section of the fourth electric motor.

The obtained virtual capacity qi is input to Table 5 shown in FIG. 11E to calculate a revolution speed command Viinv for the inverter 403 (step S735). Table 5 establishes such a characteristic that the revolution speed command Viinv increases as the virtual capacity qi increases. The revolution speed command becomes a maximum Viinv_max when the virtual capacity reaches qi_1.

The pressure of the hydraulic fluid supply path 31*b* can be maintained at the target pilot primary pressure Pi0 by controlling the revolution speed of the electric motor 3 in accordance with the flowchart described above.

The pressure of the hydraulic fluid supply path 31*b* is maintained at the fixed value Pi0. Accordingly, similarly to Embodiment 1, a tank pressure is generated in the signal hydraulic line 150*a* by the restrictor 150, the signal hydraulic line 150*a*, and the signal selector valves 117 and 217 in the state of not-traveling operation, while Pi0 is generated in the signal hydraulic line 150*a* by the restrictor 150, the signal hydraulic line 150*a*, and the signal selector valves 117 and 217 in the state of traveling operation.

The pilot pressure Pi0 generated in the hydraulic fluid supply path 31*b* is also used as a hydraulic source of each of the pilot valves 60*a*, 60*b*, 60*c*, 60*d*, 60*e*, 60*f*, 60*g*, and 60*h* for operating the respective actuators 3*a*, 3*b*, 3*c*, 3*d*, 3*e*, 3*f*, 3*g*, and 3*h* via the selector valve 33.

A control method of the electric motor 2*c* which drives the main pump 302 will be next described with reference to FIG. 9.

The revolution speed control section 90*c* of the controller 90 for the motor 2*c* inputs an output signal $V_0$ of the dial 91 to Table 1 shown in FIG. 11A to calculate the target LS differential pressure Pgr (step S600). A characteristic shown in Table 1 simulates the characteristic of the prime mover revolution speed detection valve 13 of Embodiment 1, generally showing such a characteristic that the target LS differential pressure Pgr increases as the operation signal $V_0$ of the dial 91 increases. An output signal $V_0$_2 of the dial 91 corresponds to an inflection point where a change rate of the target LS differential pressure becomes constant. When the output signal of the dial 91 reaches $V_0$_3, the target LS differential pressure becomes a maximum Pgr_3.

Figure 11G:
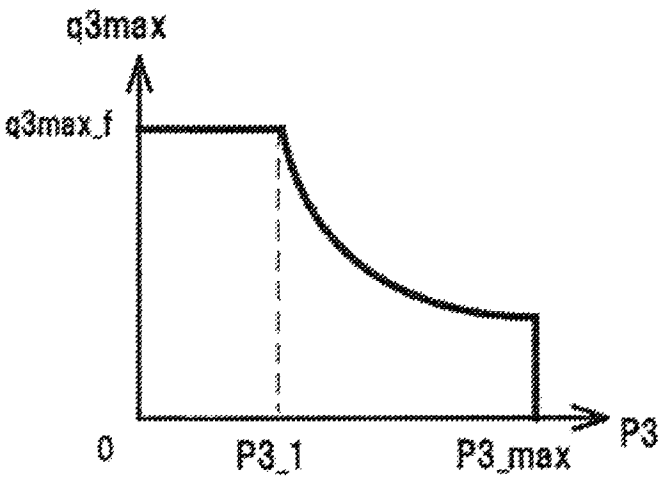
FIG. 11G is a chart showing a table characteristic of a delivery pressure of the third pump and the maximum virtual capacity, the table characteristic being used by the revolution speed control section of the third electric motor.

The delivery pressure P3 of the main pump 302 is obtained from a detection signal of the pressure sensor 83, and input to Table 7 shown in FIG. 11G to calculate a maximum virtual capacity q3max (step S605). As shown in FIG. 11G, Table 7 has a characteristic simulating horsepower control of the main pump 302. More specifically, Table 7 establishes such a characteristic that a maximum virtual capacity q3_max, where absorption torque of the main pump 302 becomes constant, decreases when the delivery pressure P3 of the main pump 302 becomes higher than P3_1.

A pressure of the signal hydraulic line 150*a* is obtained from a detection signal of the pressure sensor 80 to determine whether traveling has been operated (step S610).

Based on a result of the above determination, an LS differential pressure Pls3 corresponding to an output from the pressure sensor 87 is determined as an actual LS differential pressure during non-traveling operation (step S615), while the minimum value in an LS differential pressure Pls1 corresponding to an output from the pressure sensor 85, an LS differential pressure Pls2 corresponding to a detection signal from the pressure sensor 86, and the LS differential pressure Pls3 corresponding to a detection signal from the pressure sensor 87 is determined as an actual LS differential pressure during traveling operation (step S620).

A difference between the actual LS differential pressure Pls and the target LS differential pressure Pgr is calculated as a differential pressure deviation ΔP3 (step S625).

When ΔP3>0, a virtual capacity q3 of the main pump 302 is decreased by Δq3 (step S635). When ΔP3≤0, the virtual capacity q3 of the main pump 302 is increased by Δq3 (step S640). In these steps, Δq3 is calculated by inputting ΔP3 to Table 2 shown in FIG. 11B. Table 2 establishes such a characteristic that an increment Δq3 of the virtual capacity increases as an absolute value of ΔP3 increases. When the differential pressure reaches ΔP1_3, the increment Δq3 of the virtual capacity becomes a maximum Δq3_max.

It is determined whether the virtual capacity q3 lies within a range between upper and lower limits (step S645). When the virtual capacity q3 is smaller than a lower limit q3min, q3 is set to q3min (step S650). When the virtual capacity q3 is larger than a lower limit q3max, q3 is set to q3max (step S655).

It is assumed herein that q3min is a value determined beforehand, and that q3max is a value calculated from table 7 simulating horsepower control of the main pump 302 as described above.

A target flow rate Q3 is calculated by multiplying obtained q3 by the output $V_0$ of the dial 91 (step S660).

The target flow rate Q3 is input to Table 3 shown in FIG. 11C to calculate a revolution speed command Vinv3 for the inverter 303 (step S665). Table 3 establishes such a characteristic that the revolution speed command Vinv3 increases as the target flow rate Q3 increases. The revolution speed command becomes a maximum Vinv3_max when the target flow rate Q3 reaches Q3_1.

Load sensing control can be performed within a range of torque given beforehand for respective actuators connected to the hydraulic fluid supply path 305 by controlling the revolution speed of the electric motor 2*c* in accordance with the flowchart described above.

A control method of the electric motors 2*a* and 2*b* which drive the main pumps 102 and 202 will be subsequently described with reference to FIG. 8.

The revolution speed control section 90*a* of the controller 90 for the electric motor 2*a* and the revolution speed control section 90*b* for the electric motor 2*b* each initially obtain a pressure of the signal hydraulic line 150*a* from a detection signal of the pressure sensor 80 to determine whether traveling has been operated (step S500). An operation generating a pressure in the signal hydraulic line 150*a* during traveling operation is similar to the corresponding operation in Embodiment 1.

In case of non-traveling operation, the maximum virtual capacity is set to a maximum virtual capacity qmax_f for non-traveling determined beforehand is set to (step S505).

Figure 11F:
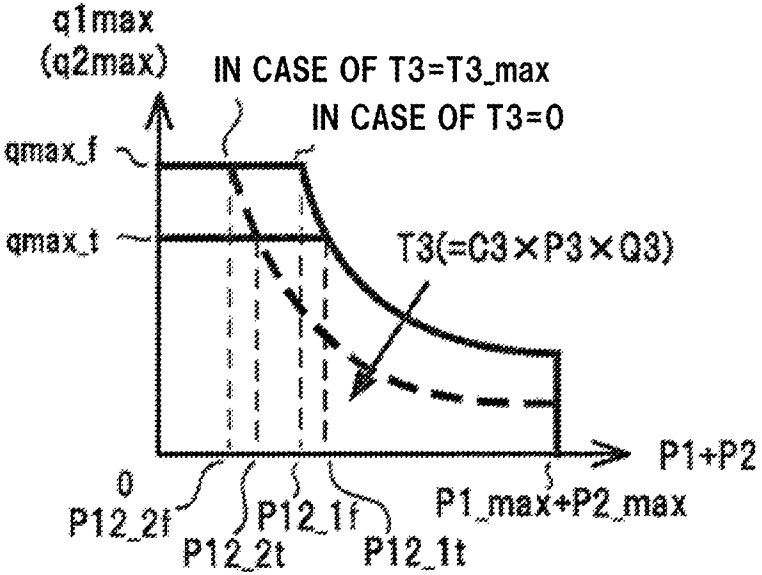
FIG. 11F is a chart showing a table characteristic of delivery pressures of first and second pumps, calculated torque of a third pump, and a maximum virtual capacity, the table characteristic being used by the revolution speed control section of each of the first electric motor and second electric motor.

Delivery pressures P1 and P2 of the main pumps 102 and 202 are obtained from detection signals of the pressure sensors 81 and 82. The delivery pressure P3 of the main pump 302 and the target flow rate Q3 of the main pump 302 described above are input to Table 6 shown in FIG. 11F to calculate a maximum virtual capacity q1max (or q2max) (step S510). In this case, C3 shown in Table 6 is a coefficient for calculating torque based on multiplication of the pressure and flow rate, and is determined beforehand. As shown in FIG. 11F, Table 6 has a characteristic simulating horsepower control of the main pumps 102 and 202, establishing such a characteristic that torque of each of the main pumps 102 and 202 decreases as torque of the main pump 302 increases.

The output signal $V_0$ of the dial 91 is input to Table 1 shown in FIG. 11A to calculate the target LS differential pressure Pgr (step S515).

For controlling the revolution speed of the electric motor 2*a*, the actual LS differential pressure Pls1 is detected from an output of the pressure sensor 85. For controlling the revolution speed of the electric motor 2*b*, the actual LS differential pressure Pls2 is detected from an output of the pressure sensor 86. In this manner, a difference from the value Pgr described above is calculated as a differential pressure deviation ΔP1 (or ΔP2) (step S520).

When ΔP1 (or ΔP2)>0, a virtual capacity q1 (or q2) of the main pump 102 (or main pump 202) is decreased by Δq1 (or Δq2) (steps S525, S530). When ΔP1 (or ΔP2)≤0, the virtual capacity q1 (or q2) of the main pump 102 (or main pump 202) is increased by Δq1 (or Δq2) (steps S525, S535). In these steps, Δq1 (or Δq2) is calculated by inputting ΔP1 (or ΔP2) to Table 2 shown in FIG. 11B.

It is determined whether the virtual capacity q1 (or q2) lies within a range between upper and lower limits (step S540). When the virtual capacity q1 (or q2) is smaller than a lower limit q1min (or q2min), q1 (or q2) is set to q1min (or q2 min) (step S545). When the virtual capacity q1 (or q2) is larger than an upper limit q1max (or q2max) corresponding to the maximum virtual capacity, q1 (or q2) is set to q1max (or q2max) (step S550).

It is assumed herein that q1min and q2min are values determined beforehand, and that q1max and q2max are values calculated from table 6 simulating horsepower control characteristics of the main pumps 102, 202, and 302 as described above.

A target flow rate Q1 (or Q2) is calculated by multiplying the obtained q1 (or q2) by the output $V_0$ of the dial 91 (step S580). The dial 91 outputs a gain of the revolution speed.

The target flow rate Q1 (or Q2) is input to Table 3 shown in FIG. 11C to calculate a revolution speed command Vinv1 (or Vinv2) for the inverter 103 (or 203) (step S585).

Load sensing control can be performed within a range of torque given beforehand for respective actuators connected to the hydraulic fluid supply paths 105*a* and 205*a* by controlling the revolution speeds of the electric motors 2*a* and 2*b* in accordance with the flowchart described above.

Meanwhile, when an initial traveling operation determination section determines that traveling operation has been performed, the maximum virtual capacity is set to a maximum traveling virtual capacity qmax_t (step S560). Thereafter, similarly to the case of non-traveling operation, the delivery pressures P1, P2, and P3 of the main pumps 102, 202, and 302, and the target flow rate Q3 of the main pump 302 are input to Table 6 shown in FIG. 11F to calculate an upper limit q1max (or q2max) of torque control (step S565).

The virtual capacity q1 (or q2) of the main pump 102 (or 202) is set to q1max (q2max) calculated from P1, P2, P3, and Q3 based on Table 6 shown in FIG. 11F described above (step S570).

The target flow rate Q1 (or Q2) is calculated by multiplying the obtained virtual capacity q1 (or q2) by the output $V_0$ of the dial 91 (step S580).

The target flow rate Q1 (or Q2) is input to Table 3 shown in FIG. 11C described above to calculate the revolution speed command Vinv1 (or Vinv2) for the inverter 103 (or 203) (step S585).

~Advantage~

According to Embodiment 3 of the present invention, where an electric motor is provided as a prime mover, advantages similar to the advantages of Embodiment 1 can be offered.

~Others~

Various modifications may be made to the embodiments described herein within a scope of spirits of the present invention.

For example, while the hydraulic fluid supply path selector valve 140 and the maximum load pressure selector valves 120, 220, and 320 switchable by hydraulic fluid of the signal hydraulic line 150*a* are constituted as different valves in the embodiments described above, these valves may be assembled into a single valve and provided as a single selector valve device.

The load sensing system of the embodiments described above is presented only by way of example, and various modifications may be made to this load sensing system. For example, the embodiments described above each include the differential pressure reducing valve which outputs a pump delivery pressure and a maximum load pressure as absolute pressures. These output pressures are introduced to the pressure compensating valve to set a target compensating differential pressure, and also are introduced to the LS control valve to set a target differential pressure of load sensing control. However, the pump delivery pressure and the maximum load pressure may be introduced to the pressure control valve or the LS control valve from different hydraulic lines.

DESCRIPTION OF REFERENCE CHARACTERS

1: Prime mover
101: Main pump of variable displacement type (first pump)
201: Main pump of variable displacement type (second pump)
301: Main pump of variable displacement type (third pump)
112: Regulator (first delivery rate control device)
212: Regulator (second delivery rate control device)
312: Regulator (third delivery rate control device)
112*a*, 212*a*: LS valve output pressure selector valve
112*b*, 212*b*, 312*b*: LS valve
112*c*, 212*c*, 312*c*: Flow rate control piston
112*d*, 212*d*, 212*e*, 312*d*: Horsepower control piston
112*f*, 212*f*: torque feedback horsepower control piston
112*g*, 212*g*: Maximum capacity selector piston
310: Torque estimation section
310*a*, 310*b*: Pressure reducing valve
31*a*, 31*b*: Pilot hydraulic fluid supply path
32: Pilot relief valve
33: Selector valve
34: Gate lock lever
13: Prime mover revolution speed detection valve
3*a* to 3*h*: Actuator
3*a*, 3*b*, 3*d*: Plurality of first actuators
3*a*: Boom cylinder
3*b*: Arm cylinder
3*d*: Bucket cylinder
3*f*, 3*g*: Plurality of second actuators
3*f*: Left traveling motor
3*g*: Right traveling motor
3*c*, 3*e*, 3*f*: Plurality of third actuators
3*c*: Swing motor
3*e*: boom-Swing cylinder
3*h*: Blade cylinder
104: First control valve block
104*a*: First valve section
104*b*: Second valve section
304: Second control valve block
105, 205, 305: Hydraulic fluid supply path
105*a*, 205*a*: Hydraulic fluid supply path
106*a*, 106*b*, 106*d*, 206*a*, 206*b*: Flow control valve (plurality of first flow control valves)
116, 216: Directional control valve (plurality of second flow control valves)
306*c*, 306*e*, 306*h*: Flow control valve (plurality of third flow control valves)
107*a*, 107*b*, 107*d*, 207*a*, 207*b*, 307*c*, 307*e*, 307*h*: Pressure compensating valve
109*a*, 109*b*, 209*a*, 309*c*, 309*e*: Shuttle valve
130*a*, 130*b*: Shuttle valve
111, 211, 311: Differential pressure reducing valve
114, 214, 314: Main relief valve
115, 215, 315: Unloading valve
120, 220, 320: Maximum load pressure selector valve
140: Hydraulic fluid supply path selector valve
150: Restrictor (traveling operation detection device)
150*a*: Signal hydraulic line (traveling operation detection device)
117, 217: Signal selector valve (traveling operation detection device)
70*a*, 70*b*: Pilot pressure reducing valve (first valve operation limiting device)
70*a*, 70*b*, 70*c*: Pilot pressure reducing valve (second valve operation limiting device)
60*a* to 60*h*: Pilot valve
102, 202, 302: Main pump of fixed displacement type
2*a*, 2*b*, 2*c*: Electric motor
103, 203, 303, 403: Inverter
80 to 87: Pressure sensor
90: Controller
91: Dial
92: Battery
501: Lower track structure
502: Upper swing structure
504: Front implement
509: Swing device
511: Boom
512: Arm
513: Bucket

The invention claimed is:

1. A hydraulic drive system of a work machine, the hydraulic drive system comprising:

a plurality of actuators including left and right traveling motors that drive left and right traveling devices, respectively, and a boom cylinder, an arm cylinder, and a swing motor that drive a boom, an arm, and a swing device, respectively;

a plurality of first flow control valves of a closed center type connected to a plurality of first actuators that include the boom cylinder and the arm cylinder in the plurality of actuators but do not include the left and right traveling motors;

a plurality of second flow control valves of an open center type connected to a plurality of second actuators that include the left and right traveling motors;

a plurality of third flow control valves connected to a plurality of third actuators that include the swing motor in the plurality of actuators but do not include the left and right traveling motors;

a plurality of pressure compensating valves that control flow rates of hydraulic fluids supplied to the plurality of first flow control valves;

first and second pumps that supply hydraulic fluids to the plurality of first and second flow control valves, and a third pump that supplies hydraulic fluids to the plurality of first and third flow control valves;

a delivery rate control device that changes delivery rates of the first and second pumps;

a traveling operation detection device that detects a traveling operation for driving the left and right traveling motors; and a selector valve device that lies at a first position for introducing hydraulic fluids delivered from the first and second pumps to the plurality of first flow control valves when the traveling operation detection device does not detect the traveling operation, and switches to a second position for introducing hydraulic fluids delivered from the first and second pumps to the plurality of second flow control valves and introducing hydraulic fluids delivered from the third pump to the plurality of first flow control valves when the traveling operation detection device detects the traveling operation, wherein:

the plurality of third flow control valves connected to the plurality of third actuators are flow control valves of a closed center type;

the plurality of pressure compensating valves include a plurality of pressure compensating valves that control flow rates of hydraulic fluids supplied to the plurality of third flow control valves;

the third pump has a maximum capacity set such that a necessary flow rate can be supplied to an actuator requiring a largest flow rate in the plurality of first actuators;

the delivery rate control device includes first, second, and third delivery rate control devices that individually change delivery rates of the first, second, and third pumps, respectively;

the first and second delivery rate control devices are configured to perform load sensing control such that delivery pressures of the first and second pumps become higher than a maximum load pressure of respective actuators driven by delivery fluids of the first and second pumps in the plurality of first actuators by a given set value when the traveling operation detection device does not detect the traveling operation and the selector valve device is located at the first position, and stop the load sensing control of the first and second pumps and drive the plurality of second actuators when the traveling operation detection device detects the traveling operation and the selector valve device switches to the second position; and the third delivery rate control device is configured to perform load sensing control such that a delivery pressure of the third pump becomes higher than a maximum load pressure of the plurality of third actuators by a given set value when the traveling operation detection device does not detect the traveling operation and the selector valve is located at the first position, and perform load sensing control such that the delivery pressure of the third pump becomes higher than a maximum load pressure of the plurality of first and third actuators by a given set value when the traveling operation detection device detects the traveling operation and the selector valve device switches to the second position.

2. The hydraulic drive system of the work machine according to claim 1, wherein the first, second, and third pumps have the same maximum capacity.

3. The hydraulic drive system of the work machine according to claim 1, wherein:

the plurality of first flow control valves include a first valve section that includes a flow control valve for the boom, and a second valve section that includes a flow control valve for the arm; and the first and second valve sections are configured such that the boom cylinder and the arm cylinder are independently driven by delivery fluids of the first and second pumps when at least either one of a boom operation for driving the boom cylinder and an arm operation for driving the arm cylinder is performed in a combined operation for simultaneously driving the boom cylinder and the arm cylinder.

4. The hydraulic drive system of the work machine according to claim 3, wherein:

the first valve section includes a flow control valve for main driving of the boom as the flow control valve for the boom, and a flow control valve for assist driving of the arm, and includes a first valve operation limiting device that holds the flow control valve for assist driving of the arm at a neutral position when the boom operation is performed; and the second valve section includes a flow control valve for main driving of the arm as the flow control valve for the arm, and a flow control valve for assist driving of the boom, and includes a second valve operation limiting device that holds the flow control valve for assist driving of the boom at a neutral position when the arm operation is performed.

5. The hydraulic drive system of the work machine according to claim 3, wherein:

the first valve section includes a single flow control valve as the flow control valve for the boom; and the second valve section includes a single flow control valve as the flow control valve for the arm.

6. The hydraulic drive system of the work machine according to claim 1, wherein:

the first and second delivery rate control devices are configured to each set a maximum capacity of each of the first and second pumps to a first value specific to each of the first and second pumps when the traveling operation detection device does not detect the traveling operation; and each switch the maximum capacity of each of the first and second pumps to a second value smaller than the first value when the traveling operation detection device detects the traveling operation.

7. The hydraulic drive system of the work machine according to claim 1, wherein:

the first, second, and third pumps are pumps of a variable displacement type driven by a prime mover, respectively; and the first, second, and third delivery rate control devices are configured to hydraulically control capacities of the first, second, and third pumps, respectively, to perform the load sensing control of the first, second, and third pumps.

8. The hydraulic drive system of the work machine according to claim 1, wherein:

the first, second, and third pumps are pumps of a fixed displacement type driven by first, second, and third electric motors, respectively; and the first, second, and third delivery rate control devices are configured to electrically control revolution speeds of the first, second, and third electric motors, respectively, to perform the load sensing control of the first, second, and third pumps.

* * * * *